US010362889B2

(12) United States Patent
Dehner et al.

(10) Patent No.: US 10,362,889 B2
(45) Date of Patent: Jul. 30, 2019

(54) RECEPTACLE FOR RECEIVING AND SECURING PACKAGES AND OTHER ITEMS

(71) Applicant: BenchSentry Inc., Littleton, CO (US)

(72) Inventors: James B. Dehner, Littleton, CO (US); Mark Soderberg, Conifer, CO (US)

(73) Assignee: BENCHSENTRY INC., Littleton, CO (US)

( * ) Notice: Subject to any disclaimer, the term of this patent is extended or adjusted under 35 U.S.C. 154(b) by 0 days.

(21) Appl. No.: 16/024,478

(22) Filed: Jun. 29, 2018

(65) Prior Publication Data

US 2019/0000255 A1 Jan. 3, 2019

Related U.S. Application Data

(60) Provisional application No. 62/527,786, filed on Jun. 30, 2017.

(51) Int. Cl.

| | |
|---|---|
| ***A47G 29/14*** | (2006.01) |
| ***B65D 8/00*** | (2006.01) |
| ***B65D 43/16*** | (2006.01) |
| ***B65D 43/26*** | (2006.01) |
| ***B65D 51/24*** | (2006.01) |
| ***B65D 55/02*** | (2006.01) |
| ***G08B 13/196*** | (2006.01) |
| ***B65D 50/02*** | (2006.01) |
| *A47G 29/30* | (2006.01) |
| *G08B 13/08* | (2006.01) |

(52) U.S. Cl.

CPC ..... *A47G 29/141* (2013.01); *B65D 15/22* (2013.01); *B65D 43/164* (2013.01); *B65D 43/26* (2013.01); *B65D 50/02* (2013.01); *B65D 51/248* (2013.01); *B65D 55/02* (2013.01); *G08B 13/19695* (2013.01); *A47G 29/30* (2013.01); *A47G 2029/145* (2013.01); *G08B 13/08* (2013.01)

(58) Field of Classification Search

None

See application file for complete search history.

(56) References Cited

U.S. PATENT DOCUMENTS

| | | | | |
|---|---|---|---|---|
| 5,078,096 | A * | 1/1992 | Bishop | A01K 1/0254 119/497 |
| 9,861,221 | B2 | 1/2018 | Jiang | |
| 10,039,401 | B1 * | 8/2018 | Romanucci | A47G 29/141 |
| 2011/0014863 | A1 * | 1/2011 | Foster | H04K 3/415 455/1 |

(Continued)

*Primary Examiner* — James M Anderson, II

(74) *Attorney, Agent, or Firm* — Kilpatrick Townsend & Stockton LLP

(57) ABSTRACT

A parcel receptacle includes a bottom member, an exterior wall that extends upward from the bottom member and that defines an interior space, and a top member that is coupled with the exterior wall and configured to cover an opening of the receptacle to enclose the parcel within the interior space. The parcel receptacle also includes a lock mechanism that is operably coupled with the top member and the exterior wall. The lock mechanism is lockable to prevent user access to the interior space and is unlockable to enable the top member to be opened to allow user access to the interior space. A vertical lip of the top member overlaps at least a portion of the exterior wall so that a seam between the top member and the exterior wall is covered by the vertical lip.

18 Claims, 16 Drawing Sheets

(56) References Cited

U.S. PATENT DOCUMENTS

| | | | | |
|---|---|---|---|---|
| 2014/0367306 | A1* | 12/2014 | Normandin | B65D 81/054<br>206/586 |
| 2015/0320209 | A1* | 11/2015 | Hasselback | H04N 5/2251<br>348/151 |

* cited by examiner

RECEPTACLE FOR RECEIVING AND SECURING PACKAGES AND OTHER ITEMS

CROSS-REFERENCE TO RELATED APPLICATIONS

This application claims priority to Provisional U.S. Patent Application No. 62/527,786 filed Jun. 30, 2017, entitled "Receptacle for Receiving and Securing Packages and Other Items," the entire disclosure of which is hereby incorporated by reference, for all purposes, as if fully set forth herein.

BACKGROUND

Parcel and package delivery is becoming increasingly common as e-commerce sales become a preferred way for consumers to purchase goods. For example, popular parcel delivery services routinely deliver nearly 6.5 billion packages or parcels each year. A common form of delivering packages or parcels involves a delivery courier placing a package or parcel on the front porch of a residential home. This delivery method, however, leaves the package or parcel relatively vulnerable to theft. For example, as of Nov. 21, 2016, approximately 23 million people had reported lost packages or other items that had been stolen from their porches. Security authorities often view these thefts as low priority crimes, but to the individual that is expecting a package delivery, these thefts are often frustrating and infuriating. In addition, these thefts may leave people feeling vulnerable within their own communities.

BRIEF SUMMARY

The embodiments described herein are directed to a receptacle that is configured to receive and secure delivered parcels, packages, and other items. According to one aspect, a receptacle is described that is positionable on a porch or other area of a home. The receptacle is configured to receive and secure a package, parcel or other item. The receptacle includes a bottom panel and four side panels that are coupled with the bottom panel and that are coupled together to form an exterior wall that extends upward from the bottom panel and that defines an interior space within which the package, parcel, or other item is positionable. The receptacle also includes a lid that is pivotably coupled with a back panel of the four side panels. The lid is configured to cover an opening at a top end of the receptacle to enclose the package, parcel, or other item within the interior space. The lid is configured to be pivoted open to enable the package, parcel, or other item to be removed from the interior space. The receptacle further includes a lock mechanism that is operably coupled with the lid and the exterior wall of the receptacle. The lock mechanism has a locked state in which the lid is locked and secured about the top end of the receptacle to prevent user access to the interior space, and the lock mechanism also has an unlocked state in which the lid is pivotable open to allow user access to the interior space. A seam between each adjacent panel of the exterior wall is covered and concealed by a component of the exterior wall so that the seam is not readily user accessible. Similarly, a vertical lip of the lid overlaps at least three sides of the top end of the exterior wall so that a seam between the lid and the top end of the exterior wall is covered by the lip.

The opposing side ends of each panel typically includes at least one interfacing member, and more commonly two interfacing members. Each interfacing member includes a through hole. The four side panels are coupled together via an initial alignment of each interfacing member with a corresponding interfacing member of an adjacent panel and via insertion of a rigid rod member through the through holes of the initially aligned interfacing members. Insertion of the rigid rod member through the through holes of the interfacing members increases a mating engagement of adjacent side panels and thereby increases a rigidity of the receptacle. The lid is pivotably coupled with the back panel of the four side panels so that as the lid is pivoted open, a top surface of the lid does not extend beyond a back surface of the back panel. As such, the lid is pivotable open when the back surface of the back panel is positioned flush against a wall of the home. The lid is pivotably coupled with the back panel of the four side panels via a hinge mechanism. The hinge mechanism is positioned relative to the four side panels so that a pivot point of the hinge mechanism is positioned above a plane that is parallel to the bottom panel and that contacts a top edge of a front panel of the four side panels. The pivot point of the hinge mechanism is also forward of a plane that is defined by a rear surface of the back panel.

The bottom panel may include a hollow cavity within which a filler material is positioned to add substantial weight to the receptacle. The receptacle typically includes a camera that is positioned atop the lid and adjacent the back panel of the four side panels. The camera is typically positioned roughly centrally between opposing side walls of the exterior wall. The receptacle may also include a lighting component that is positioned adjacent the camera and that is configured to illuminate an object in front of the receptacle when the camera is triggered to capture an image of the object. The receptacle may further include a position sensor that is configured to sense a position of the lid as the lid is opened. The sensed position of the lid may be employed to trigger the camera to capture the image at a predefined lid angle and may be further employed to increase an intensity of light that is emitted from the lighting component between an unopened lid state or angle and the predefined lid angle.

The receptacle may additionally include an input device that enables a user to input a code that transitions the lock mechanism from the locked state to the unlocked state to allow user access to the interior space of the receptacle. The receptacle may additionally include a wireless communication device that is configured to wirelessly transmit and receive data with a local area network. The transmitted and/or received data may include one or more of the following: a notification of a delivered package; a notification of an opening of the lid; a notification of a closing of the lid; an image captured from a camera; an audio recording; a theft notification; a status notification; a user access notification; and/or a combination thereof.

Accordingly to another aspect, a receptacle for securing a package may include a bottom member, an exterior wall that extends upward from the bottom member and that defines an interior space within which the package is positionable, and a top member that is coupled with the exterior wall and that is configured to cover an opening of the receptacle to enclose the package within the interior space. The lid may be configured to be opened to enable the package to be removed from the interior space. The receptacle may also include a lock mechanism that is operably coupled with the top member and the exterior wall. The lock mechanism may have a locked state in which the top member is locked and secured about the exterior wall to prevent user access to the interior space and an unlocked state in which the top member is openable to allow user access to the interior space. A vertical lip of the top member may overlap at least a portion of the exterior wall so that a seam between the top member and the exterior wall is covered by the vertical lip.

The exterior wall may include four panels that are coupled together. Opposing ends of each panel may include at least one interfacing member and each interfacing member may include a through hole. The four panels may be coupled together via an initial alignment of each interfacing member with a corresponding interfacing member of an adjacent panel and via insertion of a rigid elongate member through the through holes of the initially aligned interfacing members.

The top member may be pivotably coupled with the exterior wall so that as the top member is pivoted open, a top surface of the top member does not extend beyond a back surface of the exterior wall. The top member maybe pivotably coupled with the exterior wall via a hinge mechanism that is positioned so that a pivot point of the hinge mechanism is positioned above a top surface of the exterior wall and forward of a rear surface of the exterior wall. The bottom member may include a hollow cavity within which a filler material is positioned to add substantial weight to the receptacle.

The receptacle may include a camera that is positioned atop the top member. The receptacle may also include a lighting component that is positioned adjacent the camera and that is configured to illuminate an object in front of the receptacle when the camera is triggered to capture an image of the object. The receptacle may further include a position sensor that is configured to sense a position of the top member as the top member is opened. The position of the top member may be employed in triggering the camera to capture the image as the top member is being opened and may be further employed in increasing an intensity of light that is emitted from the lighting component as the top member is opened.

The receptacle may additionally include an input device that enables a user to input a code that transitions the lock mechanism from the locked state to the unlocked state to allow user access to the interior space of the receptacle. The receptacle may additionally include a wireless communication device that is configured to wirelessly communicate with a local area network or with a wireless communication device of another receptacle.

BRIEF DESCRIPTION OF THE DRAWINGS

The present technology is described in conjunction with the appended figures.

Figure 1:
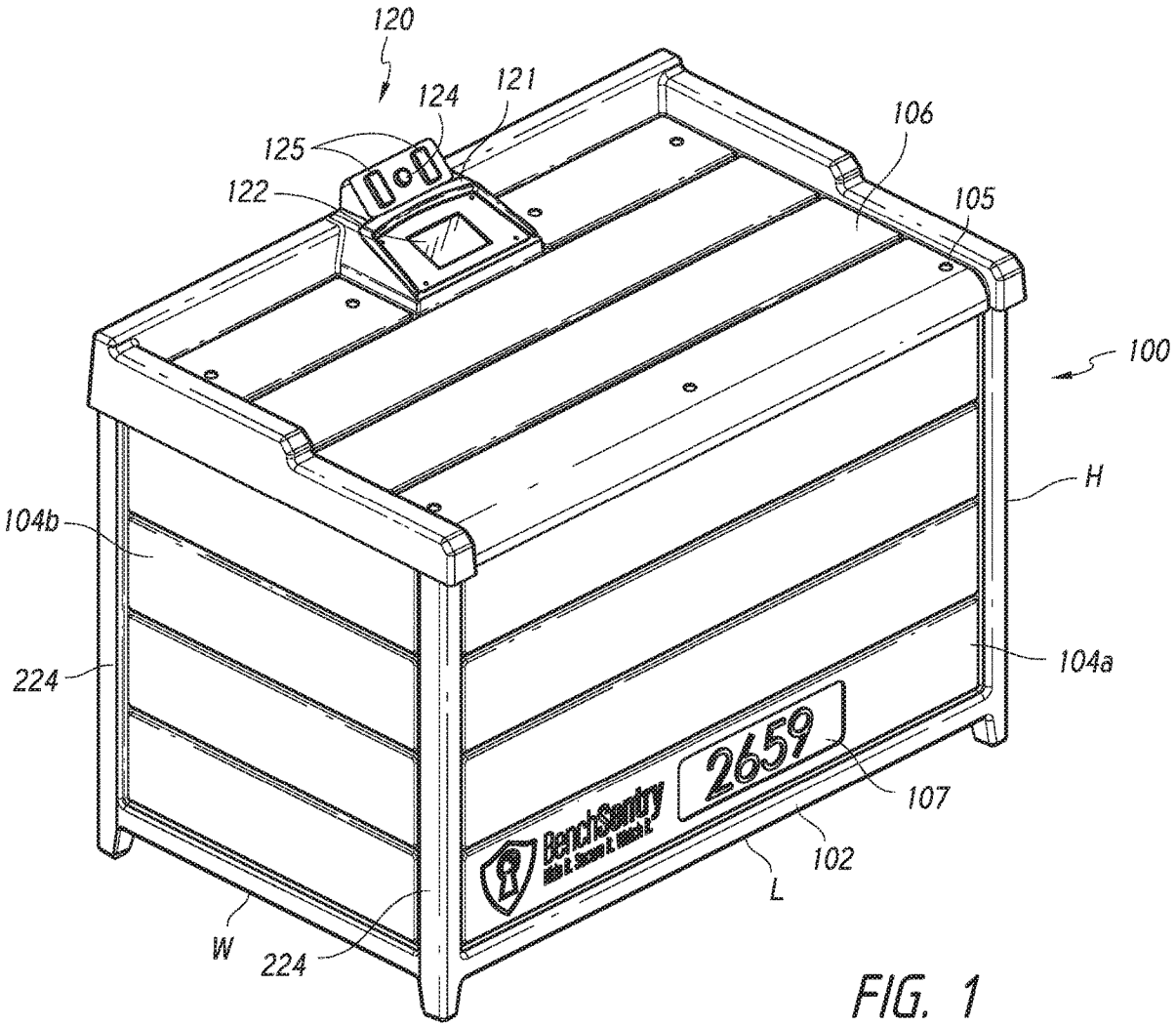
FIG. 1 illustrates a perspective view of a receptacle that is configured to accept parcels, packages, or other items for pickup or delivery.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein relate to a locking receptacle, vault, or box (hereinafter receptacle) that is capable of receiving parcels, packages, or other items for pickup or delivery. A primary purpose of the sturdy, attractive parcel receptacle is to provide theft prevention and protection from weather for delivered parcels and packages. The parcel receptacle is typically rectangular in shape, but may have any other shape as desired, such as circular, cylindrical, etc. In a specific embodiment, the parcel receptacle is sized and configured to mimic a bench, desk, or other ornamental or functional object that is commonly found on porches, patios, or landings of residential homes. The parcel receptacle may be opened by a coded mechanism or key to enable a delivery courier to place a package or parcel within the receptacle. In some embodiments, the parcel receptacle may self-close after the parcel or package is delivered or removed from the interior of the parcel receptacle.

The parcel receptacle is designed to be easy to assemble and disassemble. In assembling the receptacle, the corners are plugged together. Rigid rods may then be inserted within the corners to make the receptacle rigid. Removal of the rods from the corners of the receptacle allows the receptacle to be easily disassembled. The sides of the receptacle overlap the seams between adjacent side panels, which eliminates pry points within which a lever or pry bar may be inserted to break the receptacle apart for theft purposes. The overlapping sides also manages or prevents water intrusion into the interior of the receptacle. The lip overlaps or overhangs the upper sides of the receptacle, which eliminates pry points and water intrusion into the interior of the receptacle. The receptacle may include a compartment that is designed so that a weight or other heavy object (e.g., patio bricks, water, sand, etc.) may be positioned in the compartment. Placement of the weight within the compartment is a theft deterrent since the receptacle is significantly heavier after placement of the weight in the compartment. Exemplary materials that may be used in forming the receptacle, and/or any of the components thereof, include Polypropylene, 20% talc filled Polypropylene, acrylonitrile butadiene styrene (ABS), ABS/Polycarbonate, and combinations thereof. Having described aspects and features of the receptacle generally, additional details will be evident with reference to the various figures described herein below.

Figure 2:
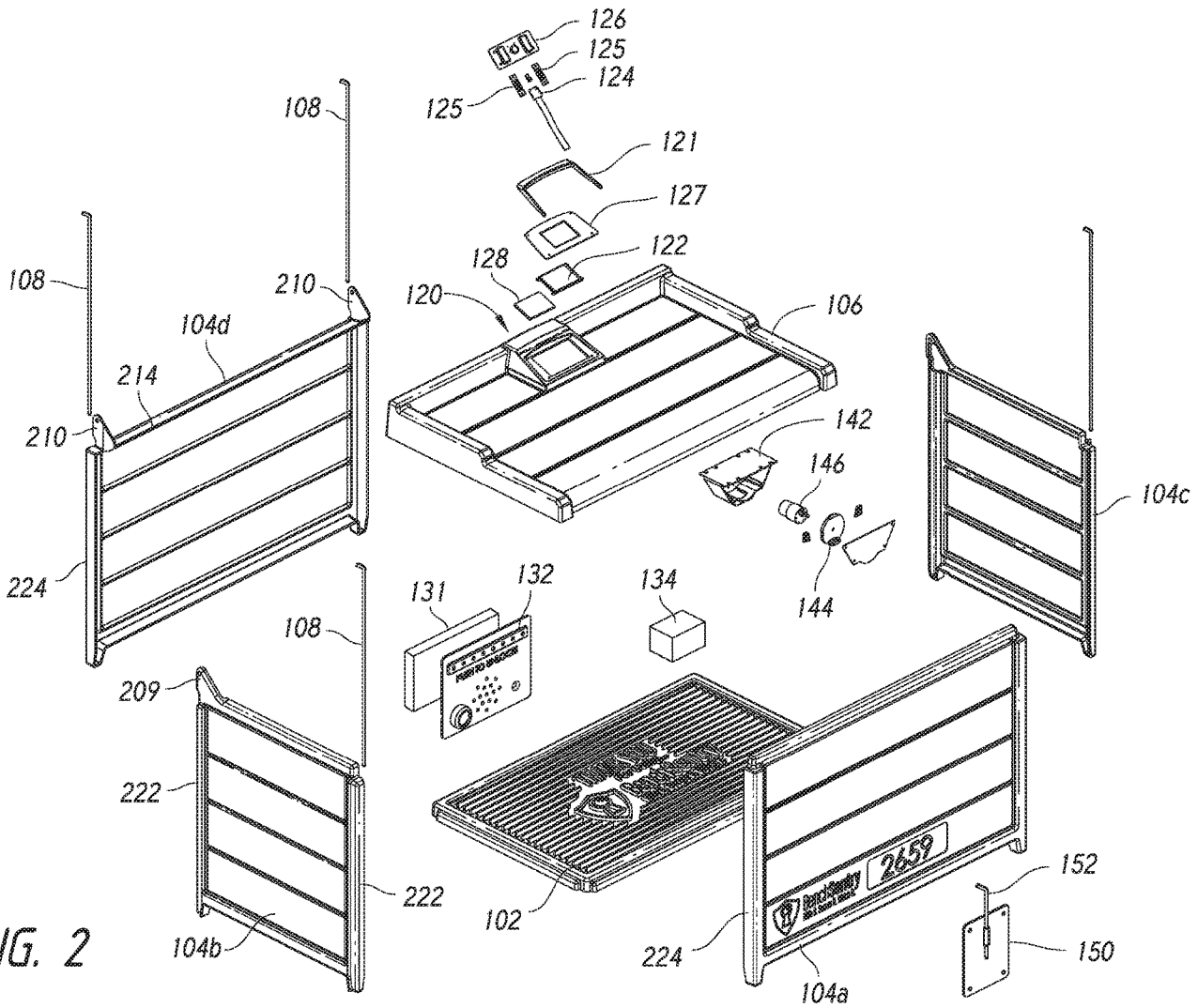
FIG. 2 illustrates an exploded perspective view of the receptacle of FIG. 1.

Referring now to FIGS. 1-2, illustrated is a receptacle 100 that is configured to accept parcels, packages, or other items for pickup or delivery. The delivered items may include: regular or small sized parcels, parcels too large for usual-sized postal boxes, food items, high value mail, and the like. Food items may be placed in an insulated bag to keep the food items cool or the receptacle 100 may have an insulated interior to protect perishable item. The receptacle 100 includes a bottom panel or member 102 and four side panels or members 104*a-d* that are coupled with the bottom panel 102 and that are coupled together to form an exterior wall that extends upward from the bottom panel 120. The bottom panel 120 and exterior wall define an interior space within which parcels, packages, and other items may be positioned for package delivery and removal. The assembled receptacle has a width W that is commonly between 15 and 30 inches, and more commonly about 23 inches. The assembled receptacle also has a length L that is commonly between 15 and 40 inches, and more commonly about 36 inches, and a height H that is commonly between 20 and 28 inches, and more commonly 24 inches.

Figure 10B:
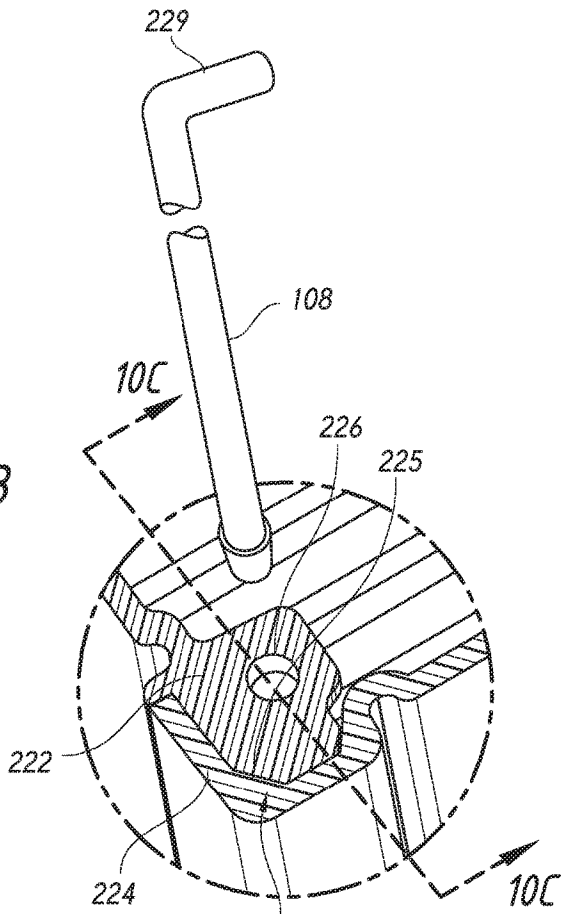
FIGS. 10A-C illustrate various views of a corner of the receptacle of FIG. 1 and, in particular, illustrate a rod that is insertable within the corner to assemble the receptacle.
Figure 10C:
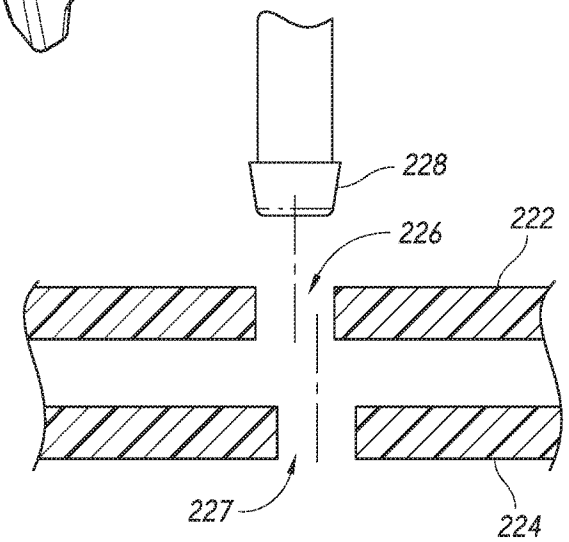
Figure 10A:
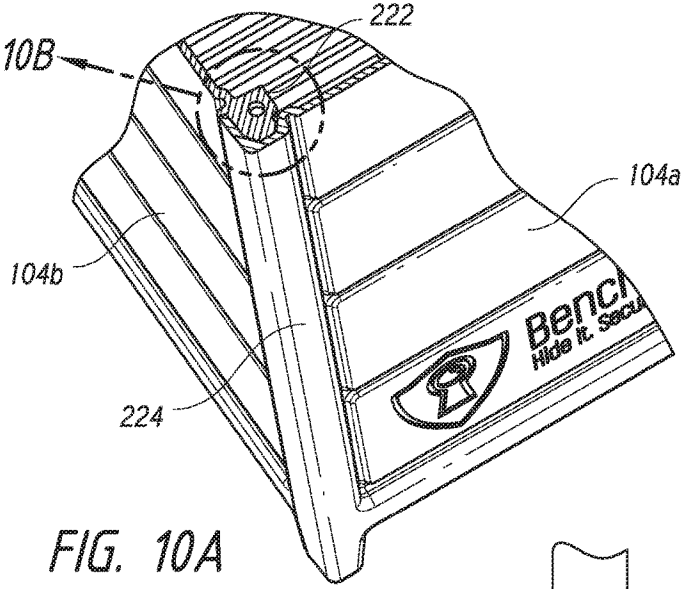
Figure 11:
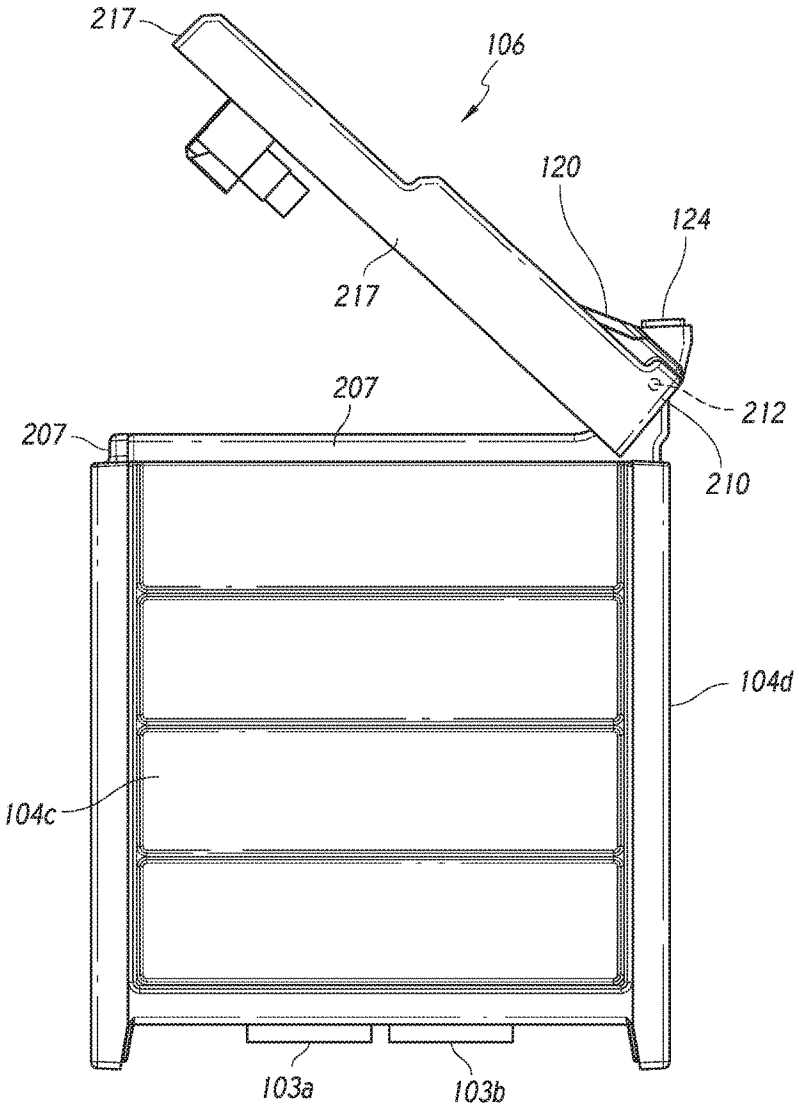
FIGS. 11-13 illustrate a coupling of a lid of the receptacle with a back panel of the receptacle.

As illustrated in FIGS. 10A-C, the receptacle 100 may be assembled by joining or assembling the corners of adjacent panels together (e.g., front panel 104*a* and side panel 104*b* in FIGS. 10A-C) so that an interfacing member of one panel (e.g., interfacing member 222 of side panel 104*b*) is positioned adjacent to, or initially aligned with, an interfacing member of an adjacent panel (e.g., interfacing member 224 of front panel 104*a*). A rod 108 may then be inserted through a through hole, 226 and 227, of each interfacing member, 222 and 224, to mate or engage the adjacent panels together.

In some embodiments, a rigidity of the receptacle 100 is increased due to insertion of the rod 108 through the through holes, 226 and 227, of the interfacing members, 222 and 224. For example, as illustrated in FIG. 10C, which is a cross section of the interfacing members (222 and 224), an axis of a through hole 226 of one interfacing member 222 may be partially offset from an axis of a through hole 227 of the other interfacing member 224 when the interfacing members, 222 and 224, are initially aligned. Insertion of the rod 108 through the misaligned through holes, 226 and 227, causes the interfacing members, 222 and 224, to axially align, which creates a mating forcing between the adjacent panels (e.g., front panel 104*a* and side panel 104*b*) that compresses the corners of the adjacent panels together. The interfacing members (e.g., interfacing member 222) includes lead-in angled edges 225 that correspond to angled surfaces 221 of the adjacent panel (e.g., front panel 104*a*). Compression of the adjacent panels' corners together via insertion of the rod 108 through the misaligned through holes, 226 and 227, forces the lead-in angled edge 225 to engage and mate with the angled surface 221 of the panel, which drives or forces the corners of the adjacent panels together and eliminates free play between the adjacent panels. Mating of the adjacent panels in this manner creates a slight interference fit between the panels that accommodates manufacturing tolerances and assures a solid connection between the panels, thereby rigidizing the exterior wall such that the panels 104*a-d* function, act, or behave as if they were a single piece. The radial offset between axes of the through holes, 226 and 227, should exceed the normal manufacturing tolerances to assure complete contact. A radial offset between the axes of between 0.75 mm and 2 mm is typically sufficient to ensure that full contact is made between the adjacent panels and some plastic deformation occurs in the through holes, 226 and 227, as intimate contact is made. An interference of 1 mm may be ideal given the range of tolerances in injection molded polypropylene at different process conditions such as injection pressure, material temperature, and mold temperature.

The lead-in angled edges 225 of the interfacing member and the angled surfaces 221 of the panel are angled sufficiently to cause a good coupling of the adjacent panels while not resulting in self-locking of the panels, which would render disassembly of the adjacent panels difficult. The angle of the edges 225 and surfaces 221 may be selected depending on the material used to manufacture the panels, although of an angle of between 5 and 30 degrees has been determined to be sufficient, and an angle of between 5 and 20 degrees is more preferred. In a specific embodiment, the angle is between 10 and 15 degrees, which provides a rigid solid connection between adjacent panels while enabling easy disassembly of the panels.

The interfacing members, 222 and 224, are typically positioned near the top and bottom of each panel so that the above described mating of the panels is achieved in both the upper and lower corners of each adjacent panel. Stated differently, adjacent coupled panels typically include two sets of interfacing members, 222 and 224, with one set being positioned in an upper corner of the adjacent coupled panels and the other set being positioned in a lower corner of the adjacent coupled panels. Additional interfacing members, 222 and 224, may be found elsewhere between the top and bottom of each panel as desired so that the adjacent coupled panels include three, four, five, or more sets of interfacing members, 222 and 224. The interfacing member 224 is commonly formed in the corner of the of the panel (e.g., front panel 104*a*) and may have a roughly rectangular shape. The other interfacing member 222 may also have a roughly rectangular shape that includes the lead-in angled edges 225.

The rod 108 may have a cap or angled end 228 that is sized slightly larger than the through holes, 226 and 227. The cap 228 may be angled or conically shaped to facilitate insertion of the rod 108 through the through holes, 226 and 227. The cap 228 may resist extraction of the rod 108 to prevent unwanted disassembly of adjacent panels. However, the cap 228 is typically designed to be extracted from the through holes, 226 and 227, to allow the exterior wall to be disassembled. In some embodiments, a proximal end 229 of the rod 108 may be bent, or have other handle means, to make it easy for an assembler to apply downward pressure on the rod 108 during insertion of the rod 108 through the through holes, 226 and 227. Similarly, a disassembler may apply an upward force to the bent end 229 for extraction of the rod 108 through the through holes, 226 and 227.

The bottom panel 102 may also include a through hole (not shown) through which the rod 108 is inserted to attach the bottom panel 102 to the exterior wall. In other instances, the bottom panel 102 may rest on a ledge formed by the exterior wall or employ other means of coupling the bottom panel to the exterior wall. The rods 108 may be removed from the panels 104*a-d*, and in some instances the bottom panel 102, to allow the panels 104*a* and bottom panel 102 to be disassembled, moved, and reassembled at another location. In some instances, the rods 108 may be made of a metal material, such as aluminum, or stainless steel. In other embodiments, the rods may be made of rigid plastic, polymer, or other materials as described. The rods are hidden and removal is prevented by the bottom of the receptacle 100 and the lid 106.

The receptacle 100 also includes a lid 106 that is pivotably coupled with a back panel 104*d* of the exterior wall. The lid 106 is configured to cover an opening of the interior space, which is typically positioned at or near the top end of the receptacle 100. The lid 106 covers the opening to enclose the packages or parcels within the interior space. The lid 106 is openable (e.g., typically pivotable open) to enable the packages or parcels to be removed from the interior space.

The lid 106 is coupled with the back panel 104*d* via a hinge mechanism. As illustrated in FIGS. 2 and 11-14, the back panel 104*d* includes an upward extending lip or protrusion 210, which in the illustrated embodiment has a triangular shape. The side panels, 104*b-c*, typically also include a similarly shaped upward extending lip or protrusion 209. The lip 210 of the back panel 104*d*, and typically the lip 209 of the side panels, includes a through hole 212 through which a coupling pin is inserted. A rear surface 219 of the lid 106 includes a slot or channel 213 that is defined between the rear surface 219 and a side wall 217 of the lid 106. The channel 213 is sized and shaped to correspond to the lip 210 of the back panel 104*d* and the lip 209 of the side panel (e.g. side panel 104*b*). Specifically, the channel 213 has a width that allows the back panel's lip 210 and the side panel's lip 209 to be inserted within the channel 213 between the rear surface 219 and a side wall 217 of the lid 106.

Adjacent the rear surface 219 on the interior of the lid 106 is a coupling member or boss 215 that includes a through hole 216 that is alignable with the through hole 212 of the lip 210 when the lid 106 is assembled with the back panel 104*d*. The coupling boss 215 is only visible and accessible from the rear or bottom of the lid 106 since the coupling boss 215 is covered and concealed by the lid's rear surface 219, upper surface, side walls 217, and a front wall 211.

To attach the lid 206 to the back panel 104*d*, the back panel's lip 210 and the side panel's lip 209 are inserted within the channel 213 and the coupling pin is inserted through the through hole 216 of the coupling boss 215 and through the through hole 212 of the back panel's lip 210. The coupling pin is also typically inserted through the through hole of the side panel's lip 209. The coupling pin is held in position relative to the coupling boss 215 and lips, 209 and 210, via a set screw 218 that is threaded into a lower surface of the coupling boss 215. In other embodiments, the coupling pin may be held in position via a detent, interference fit, or any other coupling means. Since the coupling boss 215 is only accessible when the lid 106 is pivoted open, the lid 106 cannot be removed from the back panel 104*d* wall unless the lid 106 is opened, which prevents unwanted user access to the interior of the receptacle. The lid 106 may be removed from the back panel 104*d* by removing the set screw 218 from the coupling boss 215 and removing the coupling pin.

Figure 13:
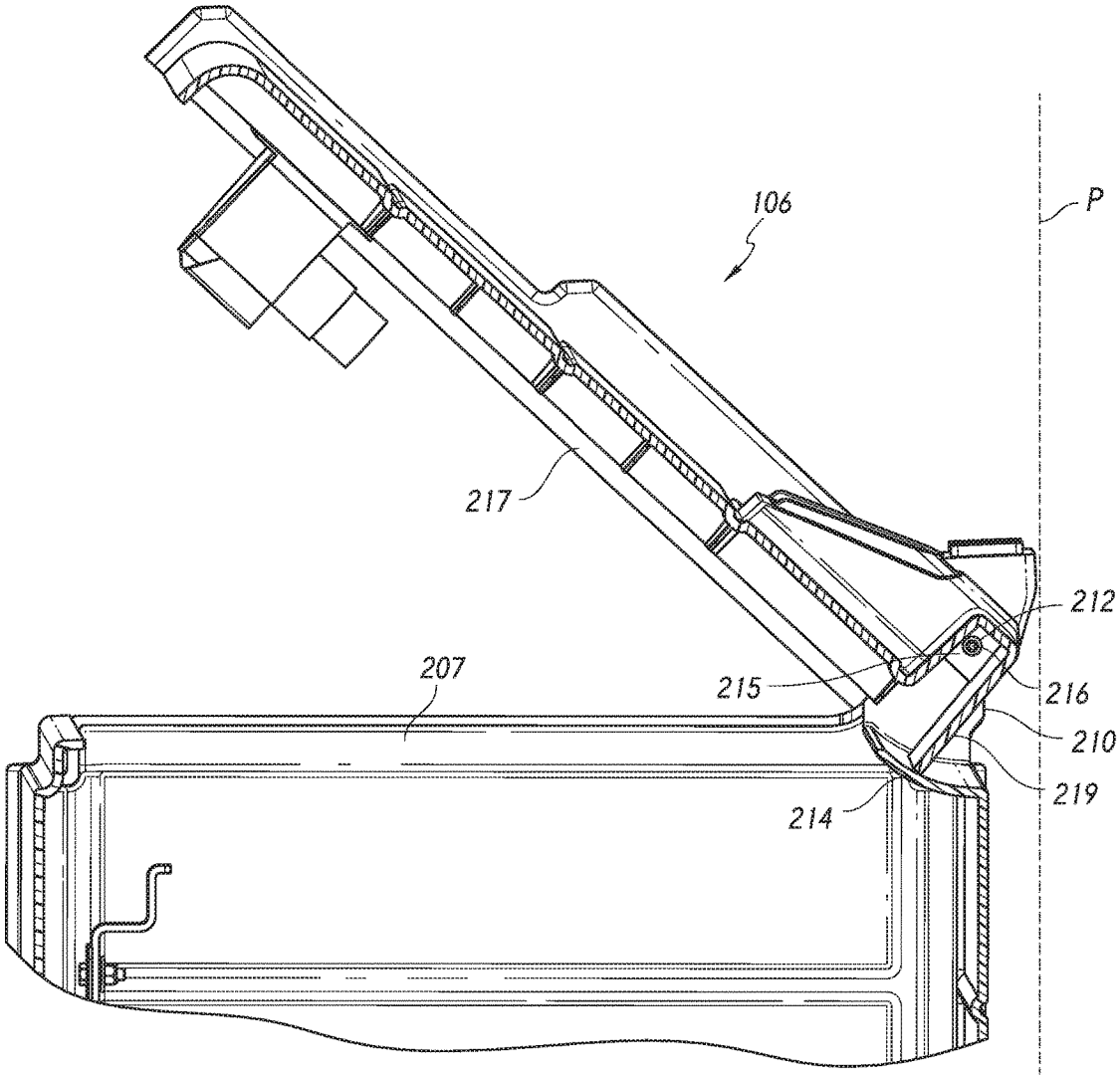
Figure 14:
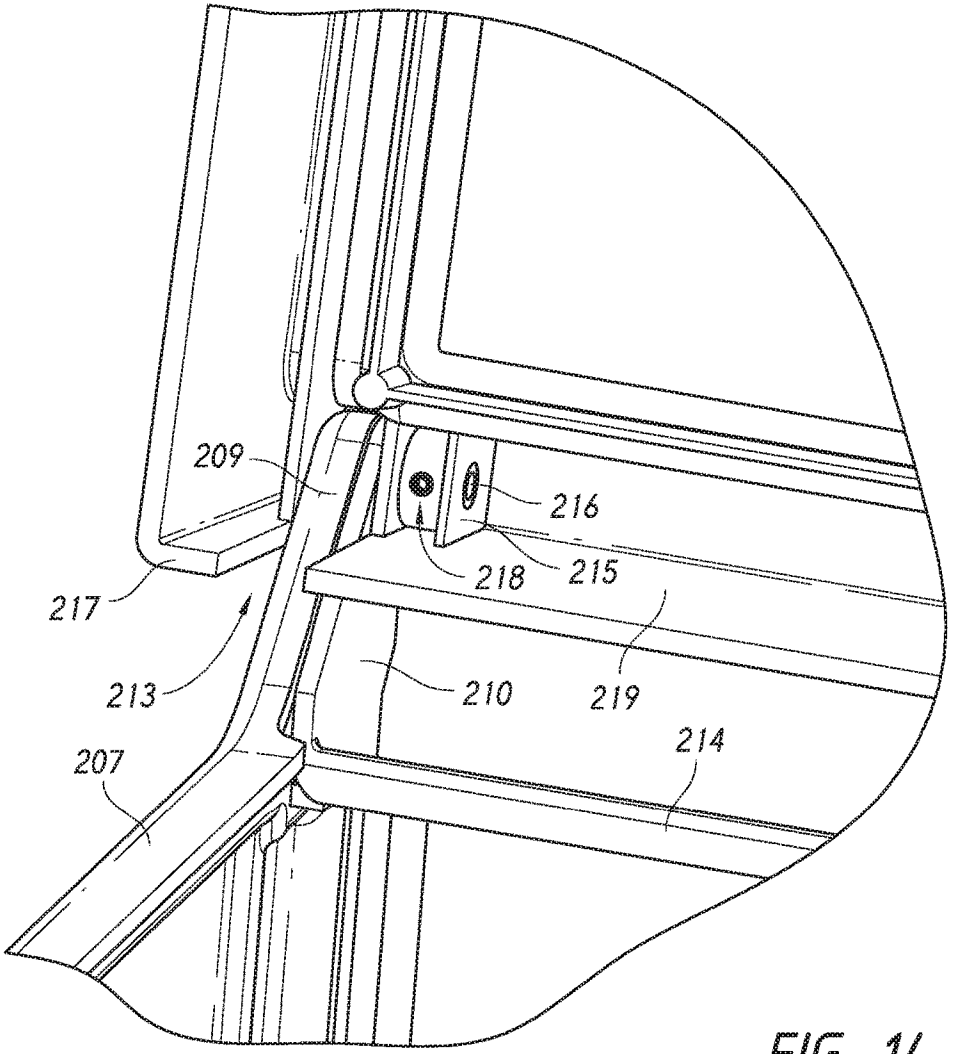
FIG. 14 illustrates a detailed view of a hinge mechanism that couples the lid with the back panel of the receptacle.

As shown in greater detail in FIG. 13, the coupling pin defines a pivot point about which the lid 106 pivots in relation to the back panel 104*d* and receptacle 100. The pivot point is positioned internally within the lid 106 as described above, which prevents unwanted disassembly of the lid 106 from the receptacle. The pivot point is positioned upward from the top surface of the exterior wall near an upper surface of the lid 106, and is also typically positioned forward of a rear surface of the back panel 104*d*. The forward and upward positioning of the pivot point enables the lid 106 to pivot about the receptacle 100 in a manner that enables the rear surface of the back panel 104*d* to be positioned relatively flush against a wall of a home or enclosure. For example, as illustrated in FIG. 13, when the lid 106 is pivoted open, the upper surface of the lid 106 (e.g., typically the console 120) does not project or extend rearward of a plane P, which is representative of a wall. Since the upper surface of the lid 106 does not extend rearward of the plane P, opening of the lid 106 will not cause the lid 106 to contact the plane P when the back panel 104*d* is positioned flush against the plane P. Therefore, the back panel 104*d* may be positioned flush against the wall without impeding or interfering with opening of the lid 106.

Figure 12:
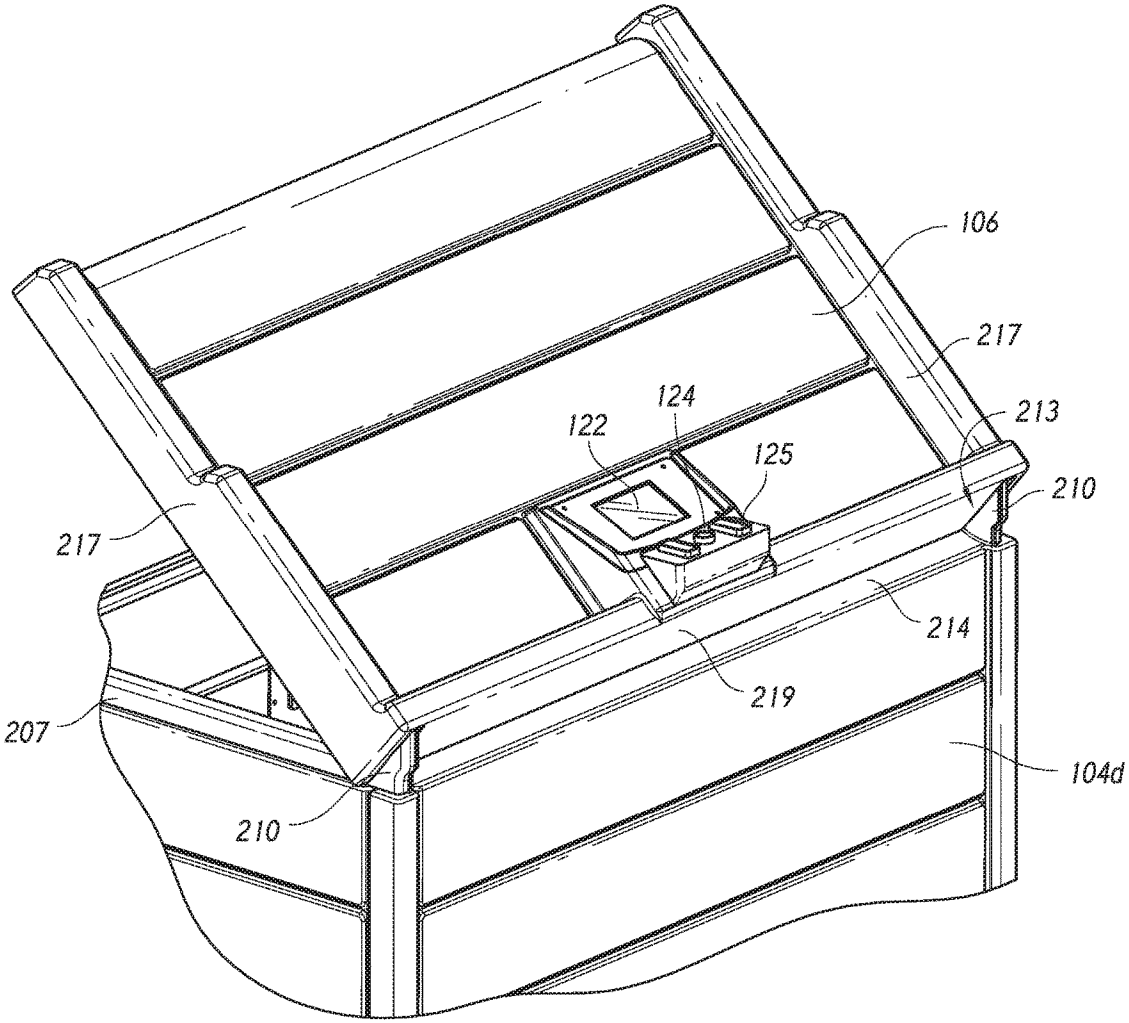

As illustrated in FIGS. 12-13, positioning of the pivot point upward from the top surface of the exterior wall, and near an upper surface of the lid 106, also enables the rear surface 219 and back panel 104*d* to function in a manner that prevents or minimizes water and other debris from entering the receptacle 100. Specifically, the back panel 104*d* includes a curved skirt 214 or lip that is positioned immediately below a bottom end of the lid's rear surface 219. The skirt 214 has a curvature that matches a path that the bottom end of the lid's rear surface 219 follows as the lid 106 is pivoted open. As such, when the lid 106 is pivoted open, the bottom end of the lid's rear surface 219 remains immediately above the back panel's skirt 214. Any water that falls atop the skirt 214, either from the lid's rear surface 219 or other surrounding objects, is immediately directed toward the rear surface of the receptacle 100. Closing of the lid 106 causes the lid's rear surface 219 to sweep or move water or other debris toward the rear surface of the receptacle 100, thereby further preventing water or debris from entering the receptacle 100.

Figure 8:
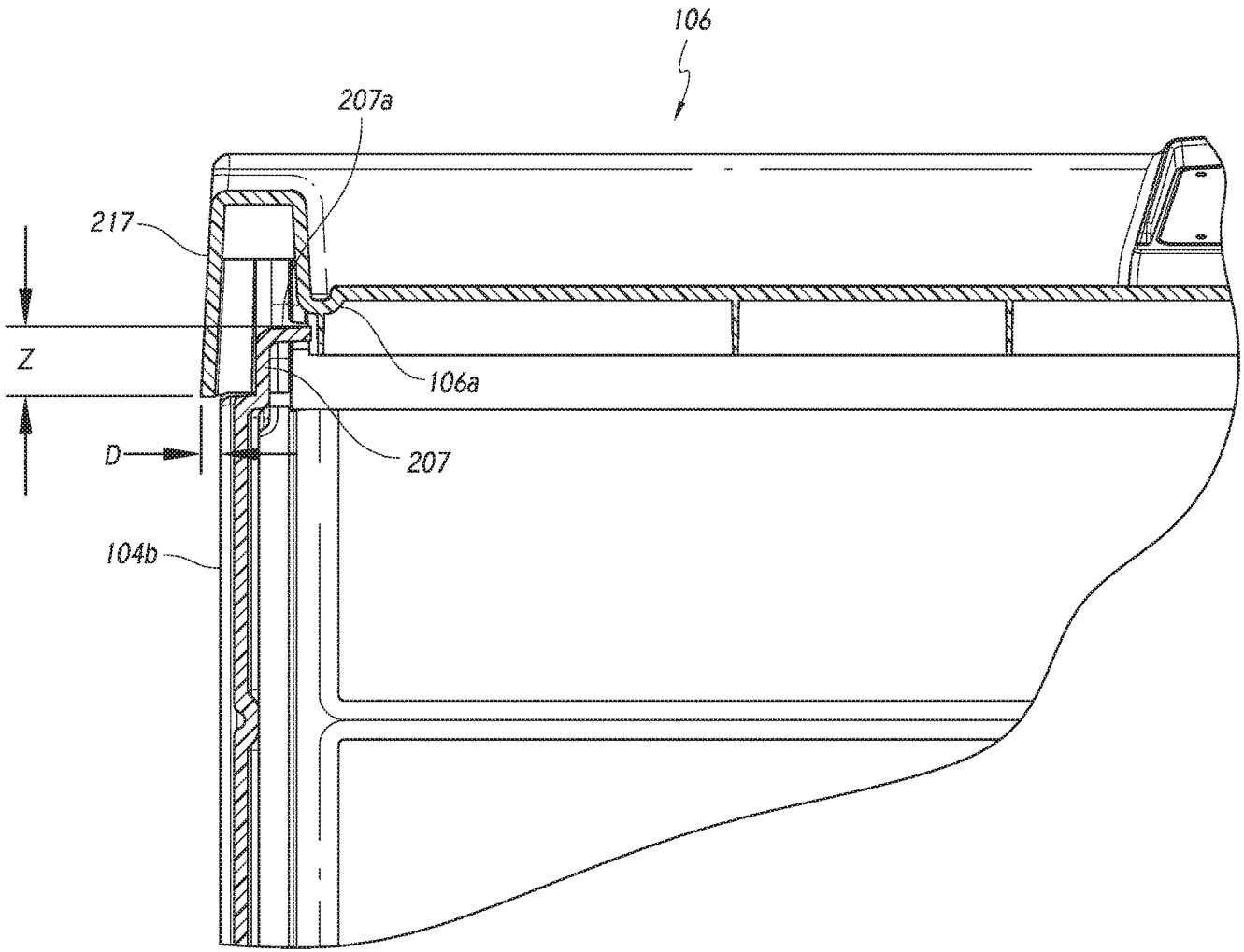
FIG. 8 illustrates a cross section view of an upper corner of the receptacle of FIG. 1.

FIGS. 8 and 11-14 also illustrate that the side walls 217 and the front wall 211 function as vertical lips that overlap an upper lip 207 of side panels 104*b-c* and an upper lip 203 of the front panel 104*a*. Overlapping of the side walls 217 and the front wall 211 with the upper lips, 207 and 203, results in an upper end of the lips, 207 and 203, being positioned vertically above a bottom end of the side walls 217 and the front wall 211 when the lid 106 is closed about the receptacle. For example, as illustrated in FIG. 8, an upper end 207*a* of the upper lip 207 is positioned vertically above the bottom end of the side wall 217 by a distance Z when the lid 106 is closed. The distance Z is typically between 1 and 2 inches, and more commonly about 1½ inches, but may be any desired dimension. The upper lip 203 of the front panel 104*a* and front wall 211 are also similarly arranged.

The upper end 207*a* of the upper lip 207 is typically curved or bent inward at roughly 90 degrees. An upper end of the upper lip 203 is similarly configured. The lid 106 includes a U-shaped rib 106*a* that extends around and adjacent the side walls 217 and, in some instances, the front wall 211. The U-shaped rib 106*a* contacts or rests on the upper end of the upper lips, 203 and 207, of the front panel 104*a* and side panels 104*b-c*. The contact point between the U-shaped rib 106*a* and upper lips, 203 and 207, defines a seam between the lid 106 and exterior wall. Since the side walls 217 and the front wall 211 of the lid 106 overlap the upper lips, 203 and 207, the seam between the lid 106 and the exterior wall is covered and concealed, and thus a pry bar or other pry object cannot be inserted between the seam to gain unwanted access to the receptacles interior space.

The overlapping arrangement of the side walls, 211 and 217, and receptacle's upper lips, 203 and 207, also prevents water from intruding into the receptacle's interior space. As illustrated in FIG. 8, the side walls 217 may extend outward from an outer surface of the side panels (e.g., side panel 104*b*) by a distance D. In such embodiments, any water or fluid that is incident on the periphery of the lid 106 is directed away from the side panel 104*b* as the fluid drains off side wall 217. The front wall 211 and front panel 104*a* may be similarly arranged. In other embodiments, the side walls 217 and/or front wall 211 may be substantially flush with an outer surface of the side panels and/or front panel. In such embodiments, water is still prevented from entering the receptacle's interior space due to the overlapping of the side walls 217 and front wall 211 with the upper lips, 203 and 207, of the side panels, 104*b-c*, and front panel 104*a*.

Similar to the arrangement of the lid 106 and upper lips, 203 and 207, the exterior wall of the receptacle 100 typically also includes a component or lip that covers and conceals a seam between adjacent panels of the exterior wall so that the seam is not readily user accessible. Specifically, as illustrated in FIGS. 2 and 10, the front panel 104*a* and the back panel 104*d* include overlapping side lips 224 that are designed to overlap a rib 222 of the side panels, 104*b-c*. The rib 222 fits within a pocket or channel that is defined by the overlapping side lips as illustrated in FIG. 10. Since the lips 224 overlap the ribs 222, a seam between the front and back panels, 104*a* and 104*d*, and the side panels, 104*b-c*, is covered and concealed, and thus a pry bar or other pry object cannot be inserted between the seam to gain unwanted access to the receptacles interior space. Although the lip 224 is illustrated as being positioned on the front and back panels, 104*a* and 104*d*, and the rib is illustrated being positioned on the side panels, 104*b-c*, it should be realized that the position of the lip and rib may be reversed as desired.

The receptacle 100 includes a lock mechanism 140 that is operably coupled with the lid 106 and exterior wall. The lock mechanism 140 is lockable (i.e., includes a locked state) in which the lid 106 is locked and secured about the receptacle 106 to secure the packages/parcels within the interior space and prevent user access to the interior space. The lock mechanism 140 is also unlockable (i.e., includes an unlocked state) in which the lid 106 is pivotable open to allow user access to the interior space for removal of the packages/parcels. The lock mechanism 140 illustrated in the drawings is an electronic lock having an locked and unlocked position in which the lock is powered off. Various other lock mechanisms could be used to secure the lid 106 about the receptacle, such as a solenoid lock, a pin tumbler mechanism, and the like.

The lock mechanism 140 may be locked and unlocked via various mechanical or electronic systems accessing Bluetooth, WIFI, or wireless communication protocols including but not limited to: a remote control unit, an RFID system, an electronic key fob, an online internet or web access point or page, a smart watch or smartphone application, and/or manually, such as by using a key or override button/code. The receptacle 100 may be opened by various entities or individuals, such as residents, delivery persons, or delivery mechanisms (e.g., drones, robots, etc.).

As illustrated in FIGS. 2 and 15-17, the lock mechanism 140 includes lock mechanism housing 142 (hereinafter latch housing 142) within which a latch wheel 144 is rotatably positioned. The latch housing 142 is defined by a plurality of walls that enclose one or more components within an interior region of the latch housing 142, such as the latch wheel 144. The latch housing 142 is attached to an interior surface of the lid 106 via any attachment means, such as by bolting, riveting, adhering, welding, or other mechanical attachments. Since the latch housing 142 is coupled with the lid 106, the latch housing 142 pivots upward with the lid 106 when the lid is opened. The latch housing 142 is typically coupled near the front panel 104*a* of the receptacle 100, although the latch housing 142 may be positioned elsewhere as desired.

A motorized device 146 is attached to one side of the latch housing 142 so that a rod or drive shaft of the motorized device is inserted through an aperture in the latch housing 142 and couples with the latch wheel 144. The motorized device 146 is configured to rotate the latch wheel 144 within the latch housing 142 between a locked state or latched position and an unlocked state or unlatched position as described in greater detail below. A limit switch 148, or other position sensor, is positioned within the latch housing 142 and is used to sense a position of the latch wheel 144 to determine if the latch wheel is in the latched position or the unlatched position.

Figure 15:
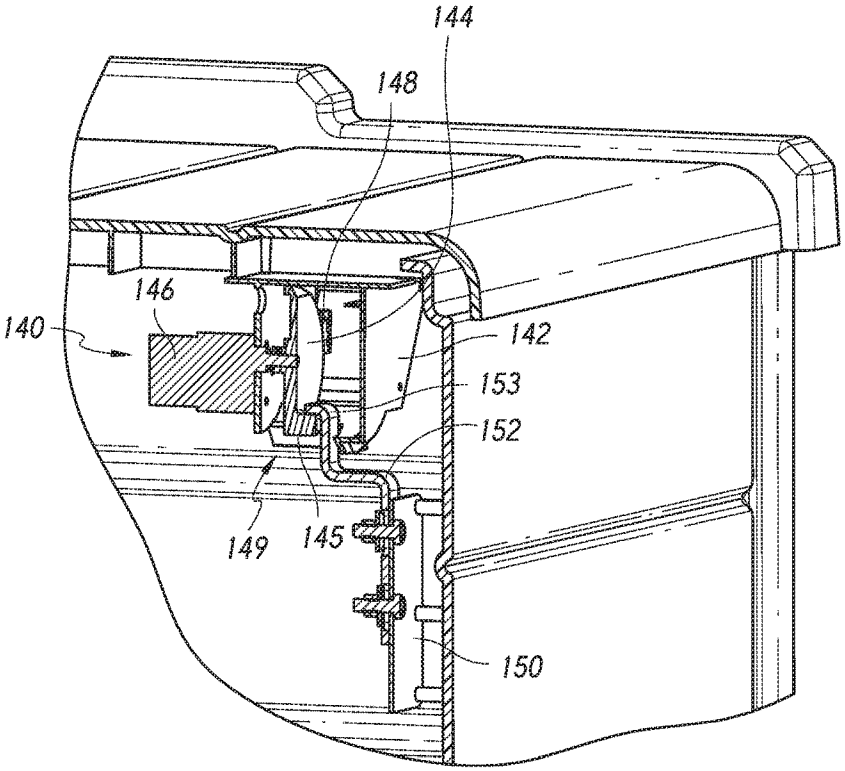

A latch 152 or rigid member is positionable through an opening 149 in a bottom surface of the latch housing 142 so that an upper curved tang 153 is positionable within the interior region of the latch housing 142. The upper tang 153 is shaped and sized to correspond with a boss or protrusion 145 that extends axially outward from an outer surface of the latch wheel 144. Specifically, when the tang 153 of the latch 152 is positioned within the interior region of the latch housing 142, the latch wheel 144 may be rotated so that the axial boss 145 is positioned under the latch's tang 153 as illustrated in FIG. 15. In this position (i.e., the latched position), the latch's tang 153 engages with the axial boss 145 to lock the lid 106 in the closed position about the receptacle 100. More specifically, the latch 152 is fixedly attached to a bracket 150, which is fixedly attached to one of the panels of the exterior wall—commonly the front panel 104*a*. Since the bracket 150 is fixed to the panel wall and the latch 152 is fixed to the bracket 150, positioning of the tang 153 above the axial boss 145, and engagement of the tang 153 and axial boss 145, prevents the lid 106 from being pivoted open. In some embodiments, the position of the latch 152 about the bracket 150 may be adjusted via bolts or other adjustment means. The position of the latch 152 about the bracket 150 may be adjusted to vary an amount of freeplay between the tang 152 and axial boss 145, to vary a closure force that is imparted on the lid 106, or for any other reason.

For theft deterrence purposes, the latch wheel 144, and more particularly the axial boss 145, may be in close proximity to the latch housing 142 when the lock mechanism 140 is in the locked state. For example, the latch wheel 144 may be positioned above a surface of the latch housing 142 so that a gap of between 0.5 mm and 1.5 mm exists between a bottom surface of the latch wheel 144, or axial boss 145, and an upper surface of the latch housing 142. A gap of about 0.75 mm is preferred between the latch wheel 144 and latch housing 142 to allow for normal tolerances such that when unloaded, there is no contact to impede rotation.

Since the latch wheel 144 is positioned in close proximity to the latch housing 142, if a person attempts to force the lid 106 open when the lock mechanism is locked, the latch wheel 144 and axial boss 145 are forced, via the tang 152, into contact with the latch housing 142, which supports and reinforces the latch wheel 144 and axial boss 145. Contact or engagement of the latch wheel 144 and latch housing 142 provides substantially greater strength to the latch wheel 144 and axial boss 145 since engagement of the latch wheel 144 and latch housing 142 causes the axial boss 145 to function as if the axial boss 145 were fixed to, or a part of, the latch housing 142. In this manner, the latch housing 142 reinforces and supports that latch wheel 144 and axial boss 145 when authorized entry into the receptacle 100 is attempted. The configuration ensures that the receptacle 100 does not rely on the cantilevered connection of the latch wheel 144 and motorized device 146 as the sole means of counteracting a lid opening force.

Figure 16:
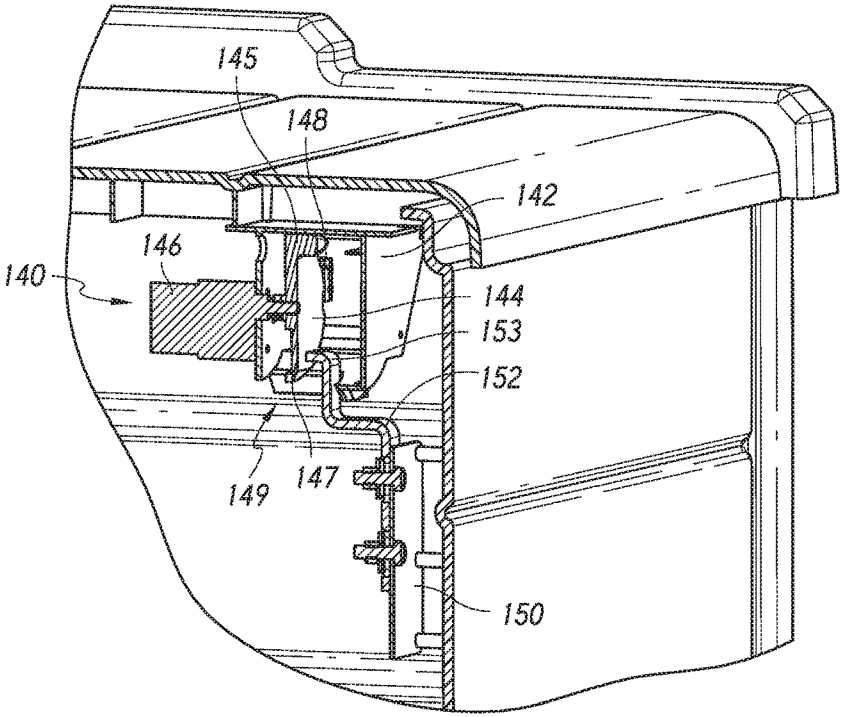
FIGS. 15-17 illustrate various view of a lock mechanism of the receptacle that is configured to releasably lock the lid about an exterior wall of the receptacle.

To unlock the lid 106, the latch wheel 144 is rotated via the motorized device 146. The motorized device 146 rotates the axial boss 145 away from the tang 153 of the latch 152 as illustrated in FIG. 16. In this position (i.e., the unlatched position), the tang 153 of the latch 152 does not engage the axial boss 145, which allows the lid 106 to be pivoted open. As the lid 106 is pivoted open and the latch housing 142 pivots upward with the lid 106, the tang 153 of the latch 152 is withdrawn from the interior region of the latch housing 142 through the opening 149. The motorized device 146 may rotate the latch wheel 144 until the axial boss 145, or other feature or component of the latch wheel, contacts or rotates past the limit switch 148. The limit switch 148 may detect that the latch wheel 144 and lock mechanism 140 is in the unlocked state, which may trigger the motorized device 146 to cease rotating the latch wheel 144.

The lock may be reengaged by shutting the lid 106, which causes the tang 153 of the latch 152 to be reinserted through the opening 149 and into the interior region of the latch housing 142. The controller 128 of the receptacle 100 may sense that the lid 106 has been closed, or a user may input the closure of the lid 106, which may cause the motorized device 146 to rotate the latch wheel 144 so that the axial boss 145 reengages with the tang 153 of the latch 152. The limit switch 148 may detect a position of the latch wheel 144 that corresponds to an engagement of the axial boss 145 and tang 153, which may trigger the motorized device 146 to cease rotation of the latch wheel 144. In other embodiments, the reengagement of the axial boss 145 and tang 153 may be detected by other means or sensors.

Figure 17:
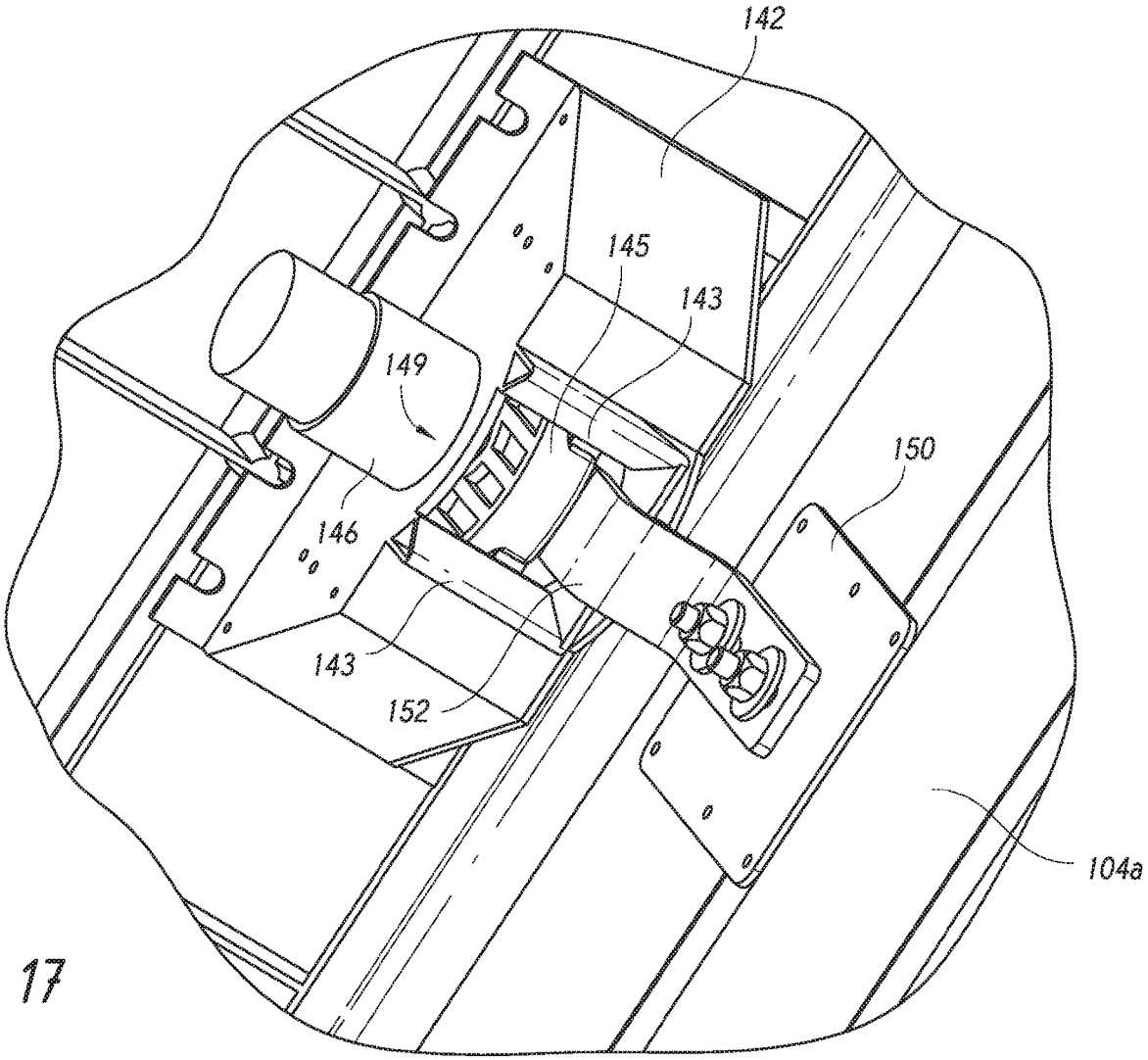

To facilitate proper reinsertion and alignment of the tang 153, the latch wheel may include a chamfered or lead-in end 147 that is angled to guide and direct the tang 153 upward through the opening 149 and into the interior region of the latch housing 142. The axial boss 145 may also be tapered or angled to facilitate reengagement of the tang 153 and axial boss 145 as the axial boss is rotated into alignment with the tang 153 via the motorized device 146. As illustrated in FIG. 17, opposing sides 143 of the opening 149 may be chamfered or angled to guide the tang 153 during reinsertion of the tang 153 into the latch housing 142.

As further illustrated in FIG. 17, the opening 149 of the latch housing 142 may be sized slightly larger than the latch 152. For example, the opening 149 may have a slightly greater width than a width of the latch 152. In some embodiments, a width of the opening 149 may be 5-35% larger than a width of the latch 152, and more commonly 10-25% or 10-20% larger. The slightly greater width of the opening allows the latch 152 to be inserted through the opening 149 while also functioning to keep or maintain the lid 106 in the locked state when the receptacle 100 is moved, shifted, moved, or skewed. Specifically, since the opening 149 is slight larger than the width of the latch 152, when the receptacle is bent, skewed, shifted, or moved, movement of the tang 153 relative to the latch housing 142 will cause a side of the latch 152 to contact one of the opposing sides 143 of the opening 149. Contact between one of the sides 143 of the opening 149 and the latch 152 functions to maintain the latch 152 and tang 153 in a proper alignment with the axial boss 145 within the latch housing's interior region. In this manner, the tang 153 and axial boss 145 remain engaged in the latched state even when the receptacle 100 is bent, skewed, shifted, or moved. Accordingly, a would be thief is prevented from gaining unwanted access to the interior of the receptacle 100 due to bending or skewing the exterior walls and/or lid.

In some embodiments, the receptacle 100 may be designed to have a little freeplay, or relative movement, between the tang 153 and axial boss 145. The freeplay or relative movement between the tang 153 and axial boss 145 may be detected by a sensor of the receptacle 100, such as an accelerometer 136. The freeplay between the tang 153 and axial boss 145 allows the receptacle 100 to accommodate some degree of warpage of the lid 106 relative to the exterior walls, which allows the lock mechanism 140 to engage even when the lid 106 does not make full contact with a top edge of the front panel 104*a*. The freeplay, or relative movement of the lid 106, can be detected by the accelerometer 136, or other lid position sensing means, to determine that an individual is attempting to open the lid 106. This initial lid opening detection can be used to turn on a backlight for the display 122, to display a special message, and/or trigger an audio prompting for a delivery courier to enter an appropriate access code.

In some embodiments, the controller 128 may be configured to detect and/or record lid 106 events, such as a lid opening, a lid closing, a captured image from a camera 124, and the like. The controller may send notification of one or more of these events to the users, such as a notification that the lid has been opened, a photograph has been taken, and/or that the lid has been closed. A notification of an omission of one of these events may also be sent to the user when applicable, such as the detection of a lid opening even without a corresponding lid closing event within a defined amount of time. The user may thereby be alerted to one or more activities that are likely occurring, such as a package delivery, a package removal, and the like. The notifications may also enable the user to correct an identified condition. For example, the user may be alerted that a lid closing event has not been detected, which enables the user to contact another occupant of the home or enclosure, or a neighbor, to check on the condition or status of the receptacle 100. The identified non-closure of the lid 106 may be due to an object, such as a rod or package, interfering with closure of the lid 106, which may be quickly and easily corrected.

Figure 7:
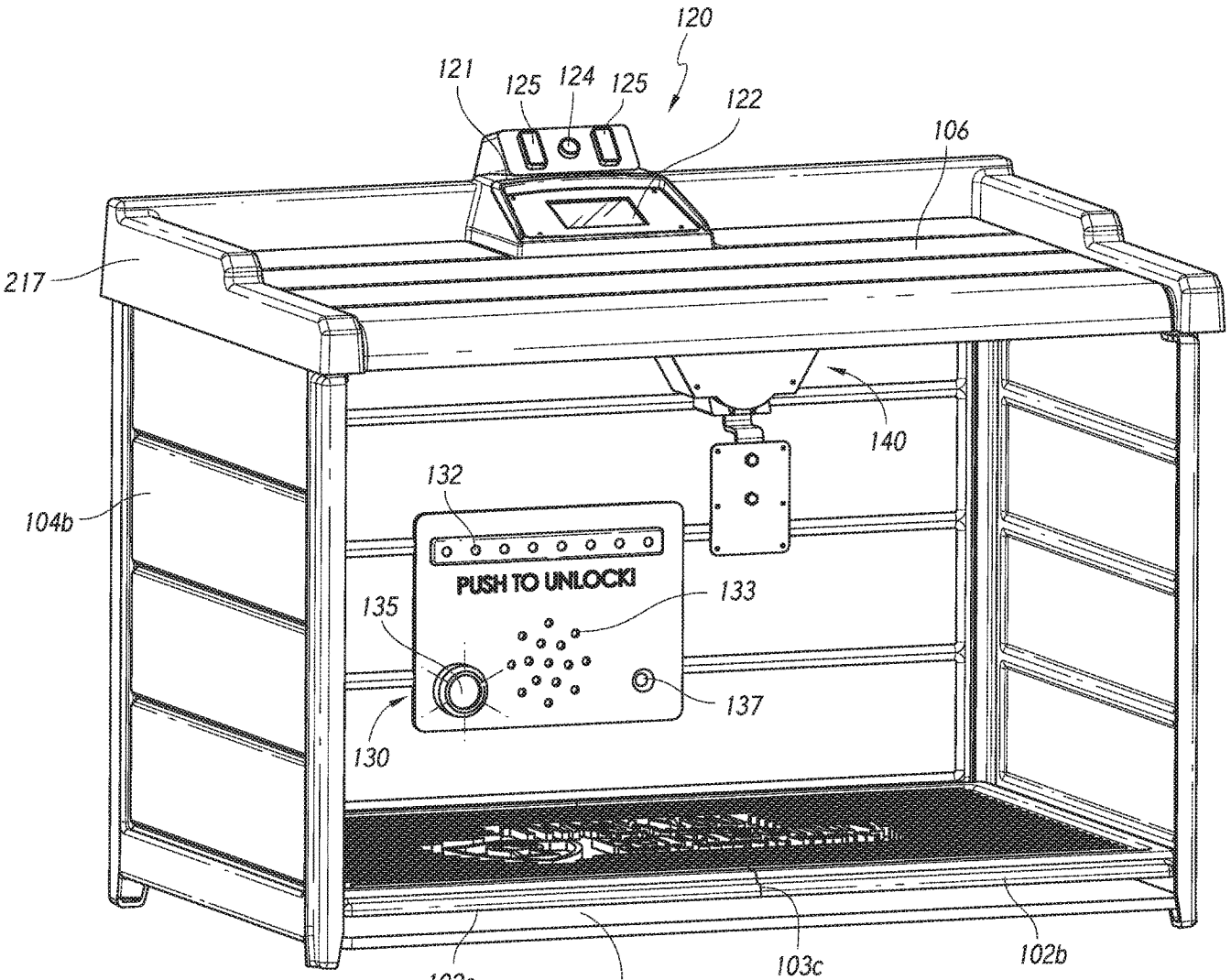
FIG. 7 illustrates a perspective view of the receptacle of FIG. 1 with a front panel of the receptacle removed to show various interior components.

Referring now to FIG. 7, in some embodiments the bottom panel 102 of the receptacle 100 has or includes a compartment that is shaped and sized so that a filler material may be positioned within the bottom panel 102 to add substantial weight to the receptacle 100. In a specific embodiment, the bottom panel 102 includes a hollow cavity 103 within which the filler material may be positioned to add weight to the receptacle 100. The filler material may include patio bricks, sand, water, other any other material that adds a substantial amount of weight to the receptacle 100. The added weight that is positioned within the compartment or cavity 103 may deter theft of the receptacle 100 by making the receptacle very difficult to lift and move. The compartment or cavity 103 may be accessed via interlocking panels, 102*a-b*, that are openable relative to the bottom panel 102 and/or relative to one another and that interlock with the bottom panel once the filler material is positioned within the cavity 103. The interlocking panels, 102*a-b*, may abut at a seam 103*c* between the panels. In other embodiments, the panels, 102*a-b*, may represent lids or covers that may be removed from the bottom panel 102 to allow a user to access the compartment or cavity 103. In other instances, weighted members, 103*a-b*, (e.g., patio bricks, sand/water filled members, etc.) may be attached to a rear surface of the bottom panel 102 to add substantial weight to the receptacle 100 (see FIG. 11). The filler material may be removed when the user desires to move the receptacle 100 to another location. Access to the compartment or cavity 103 may be only enabled from the interior of the receptacle 100, which prevents a would be thief from removing the filler material.

Figure 9:
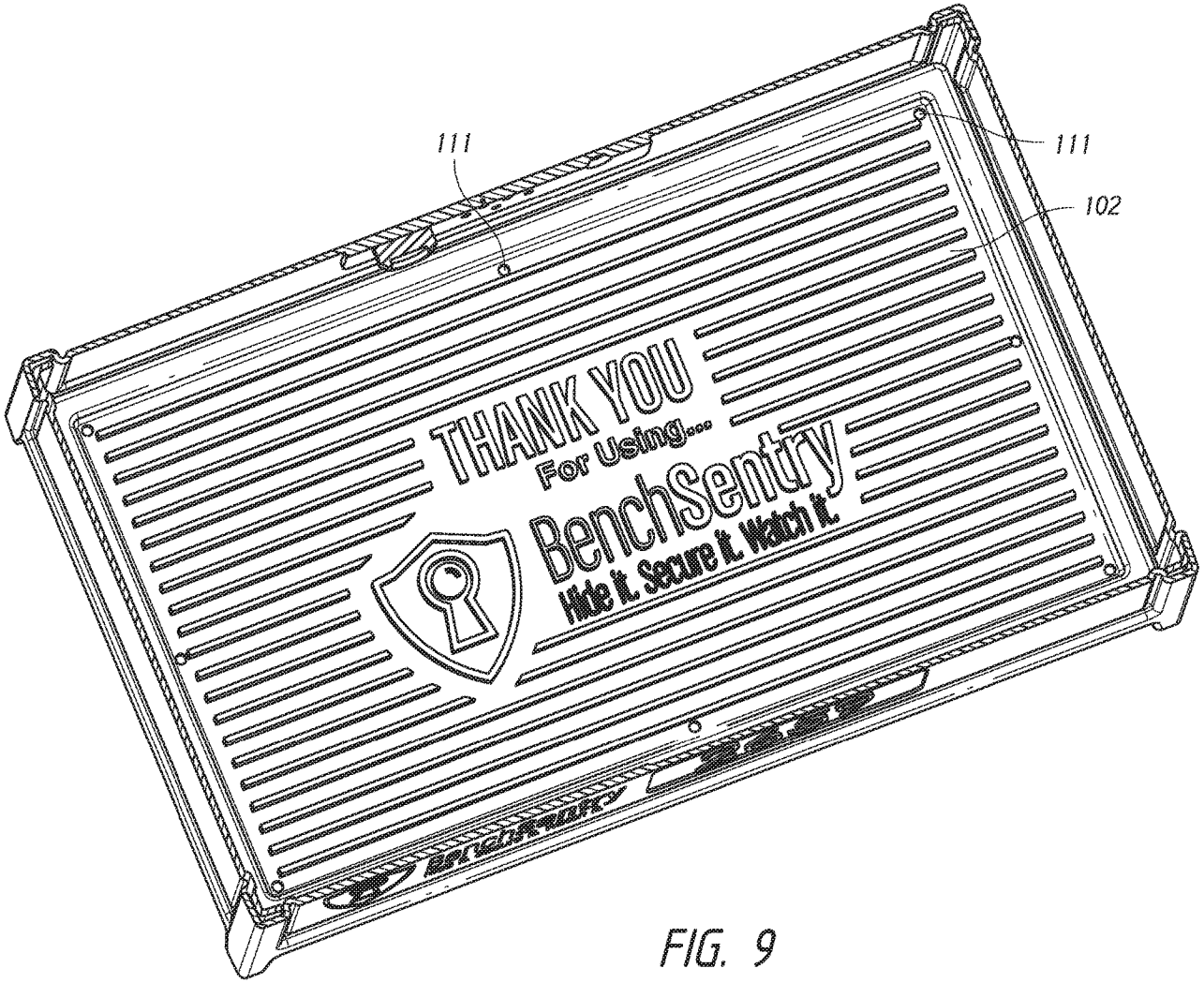
FIG. 9 illustrates a perspective view of the receptacle of FIG. 1 with a lid of the receptacle removed to illustrate an interior region of the receptacle.

As illustrated in FIG. 9, in some embodiments the bottom panel 102 may include drains holes 111 that allow water or other fluids within the interior of the receptacle 100 to drain. For example, the drain holes 111 may drain liquid that is leaking from a delivered package, which may help ensure that other packages within the receptacle 100 are not damaged due to leaking of the liquid. The drain holes 111 may also drain water that is within the interior of the receptacle, such as when the lid 106 is unintentionally left open during a storm and the like. The drain holes 111 may be channels that pass through the bottom panel and are sealed or closed off from the compartment or cavity 103 to ensure that the filler material is not able to escape through the drain holes 111.

Figure 3:
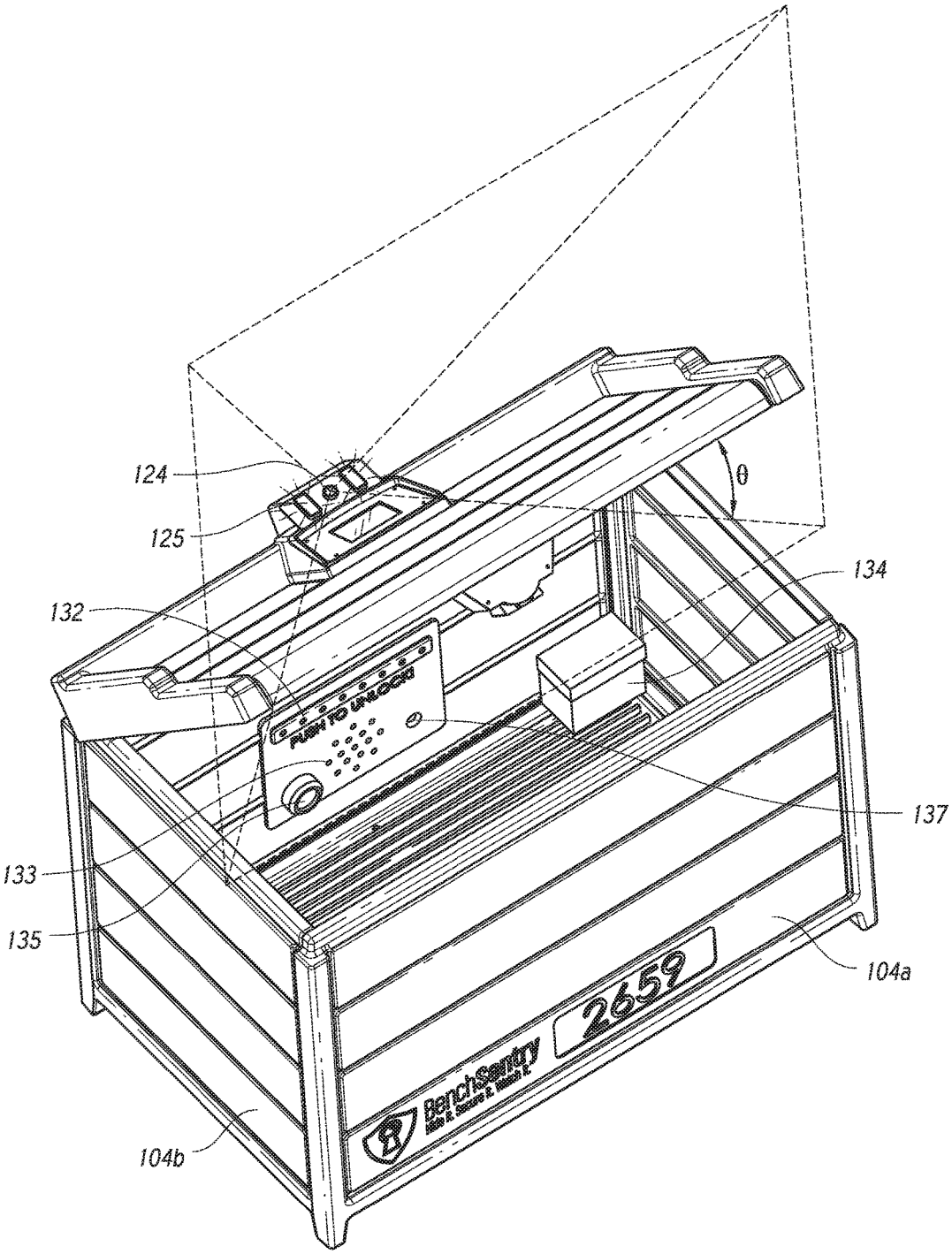
FIG. 3 illustrates a perspective view of the receptacle of FIG. 1 with a lid of the receptacle open to receive a parcel, package, or other item.

Referring now to FIGS. 1-3, the receptacle includes a console or housing 120 that is positioned on a top surface of the lid 106. The console 120 houses various electronic components, such as a camera 124, lighting components 125 (e.g., LED lights), system controller or logic unit 128, display 122, display screen or bezel 127, and the like. The console 120 is typically the interface unit for the various users that engage and interact with the receptacle 100, such as the homeowner, delivery person, etc. The display 122 may be any type of display desired, such as a numeric keypad, RFID communication device, and the like. In a specific embodiment, the display 122 is a touch screen LCD or LED display. The touch screen display 122 includes instructions for the user, such as instructions to enter a code (e.g., 4 digit code), swipe an RFID chip, or other form of proper identification. The touch screen display 122 may also alert the user to place a package or parcel within the interior of the receptacle 100 after a proper code has been entered via a numeric keypad that is displayed on the touch screen display 122. Corresponding audio instructions could be delivered to the user via a speaker 133 that is positioned on an interior console within the receptacle 100. The console 120 may include a hood 121 or other member that is designed to shade the touch screen display 122 or otherwise reduce glare.

The code that is input into the touch screen display 122 may be generated or obtained in numerous ways. For example, a homeowner or occupant may enter an access code (e.g., 4 digit code) on a website of a package courier, which a delivery person may use to gain access to the receptacle 100. The access code could be stored locally on memory of the controller 128 or other memory devices of the receptacle 100. Additional codes could be generated and given to individuals for which access to the receptacle's interior is desired, such as neighbors or local residents that are picking up parcels or packages within the receptacle for the homeowner or in response to a sell of an item that is placed in the receptacle. The homeowner may generate a master override code that allows the owner to control or perform any desired function on the receptacle 100, such as moving the receptacle 100 without sounding an alarm or other anti-theft protection. Entry of a correct access code would provide access to the receptacle 100 while entry of an incorrect code may trigger the receptacle 100 to capture an image of the person that input the code via camera 124. In incorrect entry of a code may also trigger the receptacle 100 to initiate an audio recording, which may be used along with the captured image to identify potential package thieves.

In a specific embodiment, the access code could correspond to the last 4 digits of a reference or tracking number of the package or parcel to be delivered. A user could upload the tracking/reference number on a website associated with the receptacle (e.g., courier's webpage), or to an application of a smart portable device (e.g., smartphone, tablet, smart watch, etc.) that is relayed to a local or remote accessible memory device. The controller 128 may parse the local or remote accessible memory device for the access codes to determine if the entered 4 digit code corresponds to any codes that have been input by the user and thereby grant or deny access to the receptacle's interior.

In some embodiments, the tracking/reference numbers may be obtained in a fully automated matter, such as parsing a homeowner's email, or parsing a designated email folder, to identify emails from delivery couriers that include tracking or package delivery information. A web site or smart device application may parse the emails and automatically identify and record tracking/reference numbers. The identified tracking/reference numbers could be sent to the local or remote accessible memory device so that they are available to the controller 128 when the delivery courier input the corresponding 4 digit codes into the touch screen display 122. The homeowner may establish auto folder-segregation rules within their email account so that package delivery emails are automatically segregated into folders that the homeowner has granted email parsing access to. In this manner, the homeowner may retain control of the information that is available for parsing.

In other instances, the homeowner may establish auto-forwarding rules so that package delivery email are automatically forwarded to a website or application that is programmed to perform the email parsing function and identify relevant tracking/reference numbers. The access codes—i.e., user generated, parsed tracking/reference numbers, and the like—may have usage restrictions and/or time limit restrictions as desired. For example, the codes may be designated as 1 use codes so that the codes are only usable a single time to gain access to the receptacle. In other instances, the codes could have a usage limit (e.g., 1 use, 2 uses, 3 uses, etc.) in combination with a time limit restriction. For example, the code may be designated as a single use code so that the code is usable only a single time, but the restriction could have a time limit associated with the usage so that the single use of the code could occur within a given time frame (e.g., 1 minute, 5 minutes, 10 minutes, etc.) after the code is initially input. The added time limit would eliminate issues that may occasionally occur when a single use code is entered and then the lid 106 in unintentionally or accidentally closed before the package or parcel is placed within the receptacle's interior. The time limit would allow the code to be reused within the designated time window after being initially input into the touch screen display 122. In this manner, the delivery courier or other individual could reopen the lid 106 if it is accidentally or unintentionally closed 106.

In other embodiments, the access codes could expire based on a time limit, such as 1 week, 1 month, or 1 year. The parsing technology described above may also be employed to determine if a delivery confirmation email is sent to the homeowner. The delivery confirmation information may be used to identify the corresponding access code as being expired. Information associated with entry of correct and/or incorrect access codes may be stored on the local or remote accessible memory device and/or sent to the user as desired. In regards to the memory device, a local storage of access codes and/or other relevant information may be preferred to reduce issues associated with latency and/or temporary accessibility issues to remote memory devices. The local storage of the access codes and/or other relevant information may make the receptacle 100 usable independent of remote devices and/or controls.

Other means of accessing the receptacle 100 may also be used, such as the use of RFID chips, Bluetooth technology, or other near range sensing technology. Alternatively, the receptacle 100 may employ bar code scanning technology, facial recognition technology, fingerprint technology, and the like. In some instances, GPS technology may be used and/or relayed to the receptacle 100 to enable opening of the lid 106. For example, tracking of the homeowner's cell phone may be used to determine that the homeowner is in close proximity to the receptacle 100. This information may be relayed to the receptacle to allow the receptacle to automatically unlock the lid 106. Similarly, GPS data on the location of a courier's delivery vehicle may be used and relayed to the receptacle 100 to enable the receptacle to automatically unlock when a courier's delivery vehicle is in close proximity to the receptacle.

As briefly described above, the receptacle's console 120 includes a camera 124 that is configured to capture an image and/or video segment. A screen or lens 126 typically covers the camera 124 to protect the camera's lens from external objects and/or debris. The console 120 and camera 124 are positioned atop the lid 106 adjacent the back panel 104*d* and typically roughly centrally between opposing side walls 104*b-c* of the exterior wall. Positioning the camera 124 on the back of the receptacle 100 provides a wide angle view (i.e., greatest field of view), which helps ensure that the camera 124 captures an image or video segment of a courier's face and/or other identifying features. Positioning the camera in the front of the receptacle 100 greatly reduces the field of view, which makes it increasingly difficult to capture important information. The wide field of view that is provided by positioning the camera 124 toward the back of the receptacle 100 also makes the captured image less reliant on the position of the courier in relation to the receptacle. For example, the rearward position of the camera 124 increases the odds that the camera will capture the courier's face rather than the courier's knees, legs, or pants. Positioning of the camera 124 on the top of the lid 106 also reduces or eliminates the possibility that packages, parcels, or other objects could obscure the camera 124, which may occur if the camera 124 is positioned within the receptacle 100. A suitable camera lens can provide a typical field of view (FOV) of 60+ degrees or up to a wide angle FOV of 120 degrees. A lens with an FOV of 70 degrees is typically suitable to assure the delivery courier's face and upper torso are in the FOV.

The camera 124 is communicatively coupled with the controller 128 and is configured to capture an image and/or video segment upon appropriate instruction from the controller 128. The controller 128 may instruct the camera 124 to capture an image based on proximity information from a proximity sensor, input instructions from the homeowner, a detected theft event, entry of an incorrect code, and the like. In a specific embodiment, the controller 128 is configured to instruct the camera 124 to capture an image in response to the lid 106 being opened a defined amount. Specifically, the controller 128 may detect that the lid 106 is opened by an angle θ relative to a plane defined by the upper end of the exterior wall and send a corresponding instruction to the camera 124 to capture an image and/or video recording. The angle θ may correspond to an optimal lid position for capturing an image of the courier's face and/or other identifying information, such as clothing, facial or body features (e.g., tattoos, piercings, etc.), and the like. Capturing the image based on the relative open position of the lid may eliminate or minimize the reliance of the camera 124 on proximity sensing, which may eliminate or greatly reduce an amount of captured images from non-package handling events, such as when an individual is passing in the street or ringing the doorbell. In this manner, the odds of a capture image corresponding to a package handling event are greatly increased (i.e., the occurrence of false positive information is greatly decreased), which may make the homeowner considerably more cognizant and appreciate of package related information that is sent from the receptacle 100. In some embodiments, the angle θ may be between about 10 and 70 degrees, although an angle θ of between 20 and 60 degrees is more common, and an angle θ of between 25 and 45 degrees is most common.

Figure 4:
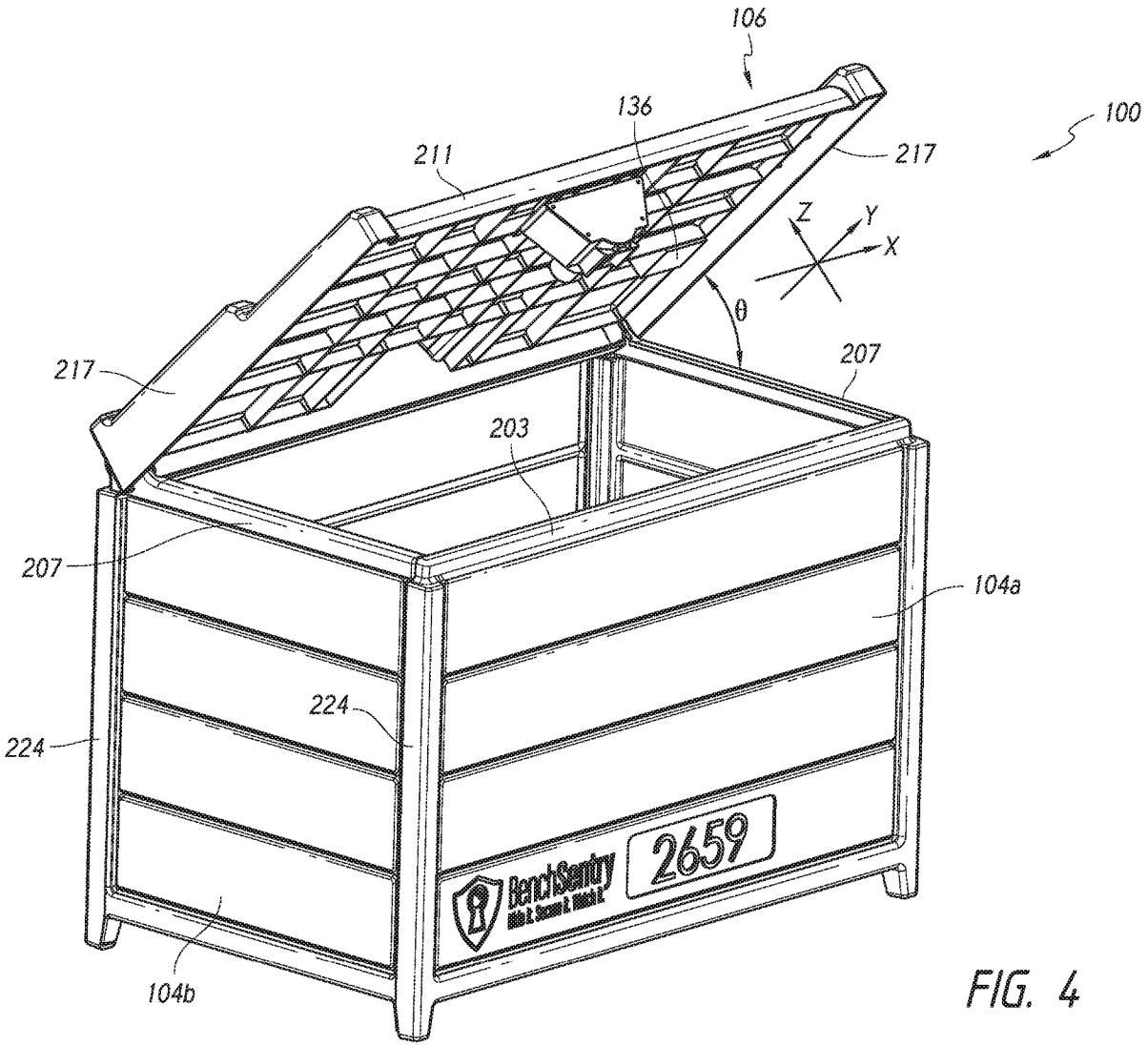
FIGS. 4-6 illustrate perspective views of the receptacle of FIG. 1 in which the receptacle includes a lid position sensing mechanism.
Figure 5:
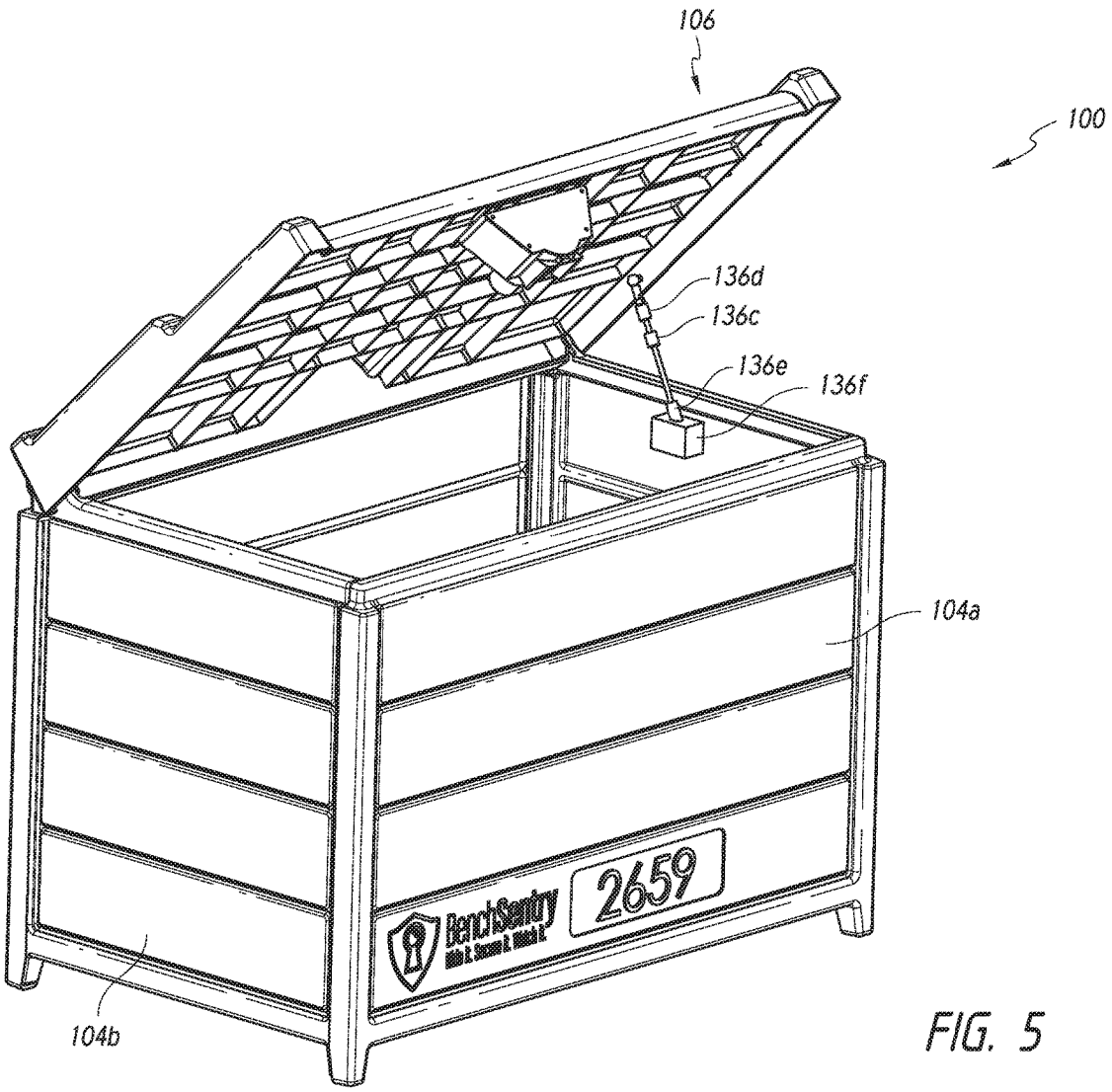
Figure 6:
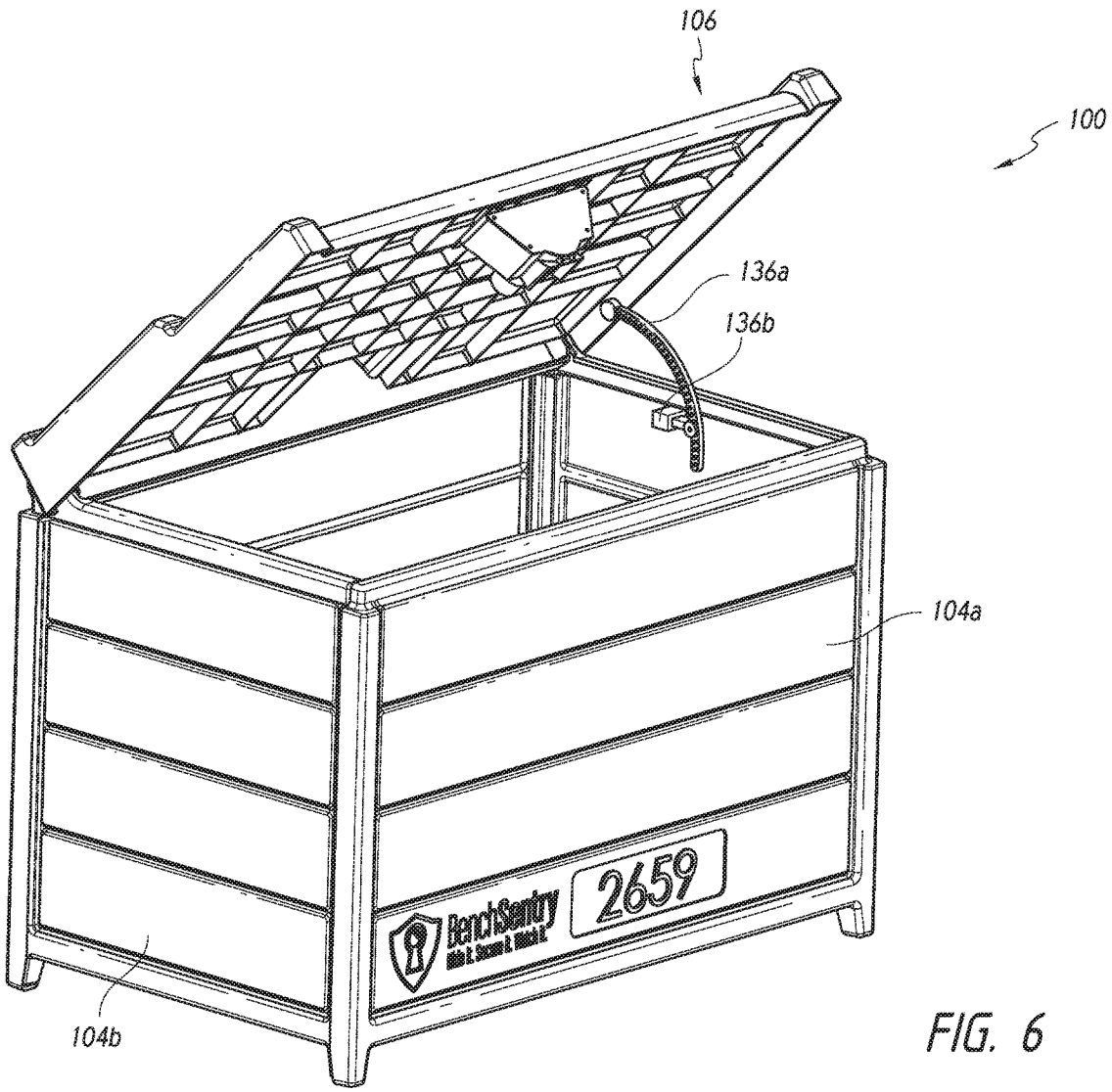

FIGS. 4-6 illustrate means in which the controller 128 may determine that the lid 106 has been opened by the angle θ relative to a plane defined by the upper end of the exterior wall. In FIG. 4, an accelerometer 136 is positioned on an interior surface of the lid 106. The accelerometer 136 is configured to sense an orientation of the lid 106, which information is relayed to the controller 128 and used to sense when the lid 106 is opened by the angle θ. The accelerometer 136 may be a gravity based accelerometer and may be programed to detect lid opening events as well as other events. For example, the accelerometer 136 may be programmed so that motion along the Y axis is used to determine when the lid 106 is opened by the angle θ. The accelerometer 136 may also be programmed to sense motion along the X and Z axes, which information may be used to detect a theft event or other event. For example, if the orientation of the receptacle 100 changes by a defined degree along an axis other than the axis of opening (i.e., Y axis), the receptacle 100 may determine that a theft event is taking place and may take appropriate action, such as sounding an alarm, transmitting information to neighboring receptacles, capturing repeated photographs or video segments at given intervals until the camera 124 loses wifi connection or other communication means, initiating an internal recording device to record external conversations, transmitting gps signals, sending text messages and/or push notification alerts to the homeowner and/or neighbors, communication with surrounding boxes, and the like. The receptacle 100 may capture repeated photographs or video segments in an attempt to capture relevant information that may be used to identify the thief, such as the individuals clothing, car details, license plate information, images of accomplices, and the like. In some instances, an initial set up process may be used to allow the accelerometer 136 to perform a self-calibration in which the accelerometer 136 determines a closed position of the lid 106 and/or determines an optimal angle θ for capturing the image.

FIG. 5 illustrates an alternative means of determining a relative position of the lid 106. Specifically, a strut 136*c* is coupled with the lid 106 and with a side panel 104*c* of the exterior wall. As the lid 106 is opened and closed, the strut 136*c* moves within or relative to a housing that is fixed to the side panel 104*c*. The strut 136*c* includes an open position notch 136*e* and a closed position notch 136*d*. The housing may be configured to sense the open position notch 136*e* and the closed position notch 136*d*. In response to sensing the closed position notch 136*d*, information may be relayed to the controller 128 to indicate that the lid 106 is closed. The open position notch 136*e* may be orientated about the strut 136*c* so that the open position notch 136*e* is sensed by the housing when the lid 106 is at or near the angle θ. In response to sensing the open position notch 136*e*, information may be relayed to the controller 128 to enable the camera 124 to capture an image as described above.

FIG. 6 illustrates another alternative means of determining a relative position of the lid 106. Specifically, a shaft 136*a* is coupled with the lid 106 and slidably coupled with the side panel 104*c* of the exterior wall. As the lid 106 is opened and closed, the shaft 136*a* moves relative to an encoder 136*b* that is fixed to the side panel 104*c*. The shaft 136*a* includes indicia that is detectable by the encoder 136*b* and in this manner, information can be relayed to the controller 128 about a relative position of the lid 106. In response to sensing that the lid 106 is open at or near the angle θ, information may be relayed to the controller 128 to enable the camera 124 to capture an image as described above.

In addition to the lid position means illustrated in FIGS. 4-6, the lid 106 may be counterbalanced and/or dampered so that upon closing, the lid 106 cannot be rapidly shut or slammed closed, which could result in injury to a user and/or damage to the receptacle 100. For example, if the lid 106 does not include a lid control mechanism, such as a counterbalance and/or damper, the lid may rapidly close on a user's fingers or arm, thereby injuring the user. In one embodiment, a gas spring mechanism may be used to both aid in reducing the force necessary for opening the lid 106 and to control the rate or speed of closing of the lid 106. The gas spring mechanism may be used with the accelerometer 136 and/or other lid position mechanisms. The strut mechanism 136*c* of FIG. 5 may represent the gas spring mechanism. Counterbalancing the lid 106 may be the preferred option for controlling the opening force and/or rate of lid closure. In such embodiments, the counterbalance force is typically less than a self-closing force so that if the lid 106 is left open by the user of a delivery courier, the lid 106 will self-close. The accelerometer 136, or other lid position sensor, may sense the position of the lid 106 to ensure that the lock mechanism 140 is not activated to lock and secure the lid 106 until the lid 106 is fully closed. The counterbalance and/or damper mechanism may be used together or in isolation as desired.

Referring again to FIGS. 2-3, the receptacle 100 includes an external lighting component 125, which in the illustrated embodiment is one or more LED lights, although other lighting components may be used. In a specific embodiment, the console 120 includes a pair of LED lighting rows or strips 125 (hereinafter LEDs 125) that are positioned on opposite sides of the camera 124. Each lighting strip may include one or more LEDs and more commonly includes a plurality of LEDs. The LEDs 125 may be covered by the screen or lens 126 to protect the LEDs 125 from external objects and/or debris. The LEDs 125 are positioned adjacent the camera 124 and are configured to illuminate an object, such as the delivery courier, that is positioned in front of the receptacle 100 when the camera 124 is triggered to capture an image or video segment of the object. In this manner, the LEDs 125 function as an electronic flash unit for the camera 124, which eliminates or reduces a reliance on ambient lighting for the captured image. The use of the LEDs 125 also greatly increases the odds of facial features and/or other important information being identifiable in the captured image.

In some instances, the LEDs 125 may be designed to illuminate immediately when the lid 106 begins to open. The LEDs 125 may initially illuminate with a relatively low light or luminous intensity to prevent the user or delivery courier from experiencing flash blindness or otherwise unwanted levels of light intensity. The light or luminous intensity may gradually increase as the lid 106 is opened, which may allow the user or delivery courier's eyes to adjust to the light. The light or luminous intensity may increase until the lid 106 is at or near the angle θ, at which point the camera 124 is triggered to capture an image of the user or delivery courier. In this manner, an individual does not experience flash blindness, but the light is sufficient to illuminate the individual when the image is captured. The control of the LEDs 125 may be based on input received from the lid position sensor (e.g., accelerometer 136) so that the relative position of the lid 106 corresponds to a light or luminous intensity of the LEDs 125. The LEDs 125 may increase in intensity as the lid 106 is opened beyond the angle θ and/or may remain illuminated until the lid 106 is closed. In some instances, the initial illumination of the LEDs 125 may be triggered by a proximity sensor sensing an individual or object approaching, which may aid in signaling the delivery courier to place the package or parcel within the receptacle 100. In other instances, the initial illumination of the LEDs 125 may be triggered by a correct entry of an access code or a movement of the lid 106. In some instances, a color of the LEDs 125 may change as the lid is being opened to make the user interaction with the receptacle 100 more appealing.

Referring now to FIG. 7, illustrated is an internal panel 130 that includes one or more controls and/or functional features. Specifically, the internal panel 130 includes one or more interior light 132 that are configured to illuminate the interior of the receptacle 100 to identify areas where packages or parcels may be positioned and/or to identify which packages or parcels are positioned in the receptacle 100. In a specific embodiment the internal lights 132 are a plurality of LED lights that are arranged in one or more rows. The internal panel 130 also includes a speaker 133 that may be used to deliver audio instructions and/or warnings to delivery couriers, potential thieves, and/or other individuals. In some instances, the homeowner may access the speaker 133 and communicate with an individual that is at or near the receptacle, such as a delivery courier that is attempting to deliver a package or parcel. The speaker 133 and/or controller 128 may also include an audio recording device that is capable of recording audio. The recorded audio may be transmitted to the homeowner in real time and/or as a notification as desired.

The control panel 130 also includes an emergency release button or mechanism 135 that is designed to allow a person, such as a young child, that is trapped within the receptacle 100 to get out of the receptacle. The emergency release button 135 is designed to open the lid 106 regardless of the status of the receptacle 100. For example, the receptacle may have a default open or unlock status when a battery 134 of the receptacle loses sufficient power. Similarly, the receptacle 100 could have a default unlock status until a package or parcel is delivered, after which the lock mechanism 140 could be triggered to lock the receptacle 100. In other instances, the emergency release button 135 may be mechanically linked to the lock mechanism 140 so that operation of the emergency release button mechanically triggers or causes the lock mechanism 140 to open. The emergency release button 135 may be a lever that causes the latch wheel 144 to rotate within the latch housing 142. In this manner, an individual may always be able to escape from the interior of the receptacle.

In some embodiments, the emergency release button 135 may have a light that blinks or illuminates periodically to indicate the position of the emergency release button about the control panel 130. The control panel 130 and/or console 120 may have a wireless communication device that is configured to wirelessly transmit and received data with a local area network. In some embodiments, the transmitted data may include a notification of a delivered package, a notification of an opening of the lid, a notification of a closing of the lid, an image captured from a camera, an audio recording, a theft notification, a status notification, a user access notification, or a combination of any of such notifications. The control panel 130 may also include a reset button 137 that is used to reset or restore software, programming, or other functionality related to the receptacle 100. The control panel 130 may be attached to a power board 131 (see FIG. 2) that is electrically coupled with the battery 134. The power board 131 may regulate the power distributed to the various electronic components of the receptacle 100. In some embodiments, the power board 131 may function as a battery charger to replenish the power of battery 134. The power board 131 may function as a battery charger when the receptacle 100 includes a solar panel or is connected to an electrical outlet or receptacle.

In reference to FIG. 1, the receptacle 100 is typically configured to blend into the decorative features on the porch, patio, or other area in which the receptacle 100 is positioned. The receptacle 100 may be offered in multiple colors so that a homeowner may match the color of the receptacle 100 with a color theme of the home, porch, or patio. In other embodiments, the receptacle 100 may be paintable to enable the user to match a color scheme themselves. In addition, the receptacle 100 may be configured to allow external objects to be attached to receptacle 100 to aid in blending the receptacle 100 into a surrounding area. For example, the receptacle 100 may include snaps 105 or other coupling features that are couplable with cushions, pads, or other objects. In this manner, the receptacle 100 may be concealed so that it is not immediately identifiable by would be thieves as an object to investigate. In addition, the concealment or camouflaging of the receptacle 100 may help the receptacle 100 conform to local homeowner associate bylaws and/or other community or local ordinances. In some instances, the front panel **104*a* of the receptacle 100 may include a house number 107** or other identifying information.

The receptacle 100 may be powered via multiple power sources including battery power, plug-in wall outlet power, solar panel power, and the like. The power sources may be used alone, or in combination for with one another, such as for backup power purposes, to reduce consumption, and/or to recharge a battery power supply. In some embodiments, the receptacle 100 may include a port that contains and conceals an AC power plug.

In some embodiments, the receptacle 100 may be made out of blown or molded plastic and may look like a bench. The plastic may have an embossed grain appearance and/or may have a company logo embossed, imprinted, or otherwise displayed on one or more surfaces. Delivery instructions may also be embossed on the exterior lid of the receptacle 100. Exemplary delivery instructions include the following:

Please place deliveries in box.

Irregular-sized items require notification of resident by pressing Oversized Package Button Additionally or alternatively, the receptacle 100 may be marked with a sticker labeled "Box is Under Surveillance." The inside lid surface may be marked with the message "Thank you."

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A receptacle that is positionable on a porch or other area of a home and that is configured for securing a package, the receptacle comprising:

a bottom panel;

four side panels that are coupled with the bottom panel and that are coupled together to form an exterior wall that extends upward from the bottom panel and that defines an interior space within which the package is positionable, wherein opposing ends of each panel of said four side panels include at least one interfacing member having a through hole, the interfacing members being arranged so that as the ends of the four side panels are assembled, the through holes of adjacent interfacing members are axially offset, and wherein said four side panels are coupled together via insertion of a rigid rod member through the through holes of the adjacent interfacing members, wherein said insertion of said rigid rod member axially aligns the through holes of the adjacent interfacing members and thereby increases a mating engagement of adjacent side panels and increases a rigidity of the receptacle;

a lid that is pivotably coupled with a back panel of said four side panels via a hinge mechanism, the lid being configured to cover an opening at a top end of the receptacle to enclose the package within the interior space, wherein the lid is configured to be pivoted open to enable the package to be removed from the interior space, and wherein the hinge mechanism is positioned relative to said four side panels so that a pivot point of the hinge mechanism is positioned above a top surface of the lid and is positioned forward of a rear surface of the back panel; and a lock mechanism that is operably coupled with the lid and the exterior wall of the receptacle, the lock mechanism having a locked state in which the lid is locked and secured about the top end of the receptacle to prevent user access to the interior space and the lock mechanism having an unlocked state in which the lid is pivotable open to allow user access to the interior space; wherein:

a seam between each adjacent panel is covered and concealed by a component of the exterior wall so that the seam is not readily user accessible;

a vertical lip of the lid overlaps at least three sides of the top end of the exterior wall so that a seam between the lid and the top end of the exterior wall is covered by the lip.

2. The receptacle of claim 1, wherein the lid is pivotably coupled with the back panel of said four side panels so that as the lid is pivoted open, a top surface of the lid does not extend beyond a back surface of the back panel such that the lid is pivotable open when the back surface of the back panel is positioned flush against a wall of the home.

3. The receptacle of claim 1, wherein the hinge mechanism is covered and concealed by the lid.

4. The receptacle of claim 1, wherein the bottom panel includes a hollow cavity within which a filler material is positioned to add substantial weight to the receptacle.

5. The receptacle of claim 1, wherein the receptacle includes a camera that is positioned atop the lid and adjacent the back panel of said four side panels; wherein the camera is positioned roughly centrally between opposing side walls of the exterior wall.

6. The receptacle of claim 5, further comprising a lighting component that is positioned adjacent the camera and configured to illuminate an object in front of the receptacle when the camera is triggered to capture an image of the object.

7. The receptacle of claim 6, further comprising a position sensor that is configured to sense a position of the lid as the lid is opened, the position of the lid being employed in triggering the camera to capture the image at a predefined lid angle and being further employed in gradually increasing an intensity of light that is emitted from the lighting component between an unopened lid angle and the predefined lid angle.

8. The receptacle of claim 1, further comprising an input device that enables a user to input a code that transitions the lock mechanism from the locked state to the unlocked state to allow user access to the interior space of the receptacle.

9. The receptacle of claim 1, further comprising a wireless communication device that is configured to wirelessly transmit and receive data with a local area network, the data including one or more of the following:

a notification of a delivered package;

a notification of an opening of the lid;

a notification of a closing of the lid;

an image captured from a camera;

an audio recording;

a theft notification;

a status notification;

a user access notification; or a combination thereof.

10. A receptacle for securing a package comprising:

a bottom member;

an exterior wall that extends upward from the bottom member and that defines an interior space within which the package is positionable, the exterior wall including four panels that are arranged so that adjacent panels are coupled together via insertion of a rigid rod through apertures of adjacent interfacing members of the adjacent panels;

a top member that is coupled with the exterior wall and that is configured to cover an opening of the receptacle to enclose the package within the interior space, wherein the lid is configured to be opened to enable the package to be removed from the interior space; and a lock mechanism that is operably coupled with the top member and the exterior wall, the lock mechanism having a locked state in which the top member is locked and secured about the exterior wall to prevent user access to the interior space and having an unlocked state in which the top member is openable to allow user access to the interior space;

wherein a vertical lip of the top member overlaps at least a portion of the exterior wall so that a seam between the top member and the exterior wall is covered by the vertical lip; and wherein the four panels are configured so that prior to the insertion of the rigid rod through the apertures of the adjacent interfacing members, the apertures of the adjacent interfacing members are axially offset such that insertion of the rigid rod through the apertures of the adjacent interfacing members axially aligns the apertures and increases a mating engagement of adjacent panels and increases a rigidity of the receptacle.

11. The receptacle of claim 10, wherein the top member is pivotably coupled with the exterior wall so that as the top member is pivoted open, a top surface of the top member does not extend beyond a back surface of the exterior wall.

12. The receptacle of claim 11, wherein the top member is pivotably coupled with the exterior wall via a hinge mechanism that is positioned so that a pivot point of the hinge mechanism is positioned above a top surface of the exterior wall and forward of a rear surface of the exterior wall.

13. The receptacle of claim 10, wherein the bottom member includes a hollow cavity within which a filler material is positioned to add substantial weight to the receptacle.

14. The receptacle of claim 10, wherein the receptacle includes a camera that is positioned atop the top member.

15. The receptacle of claim 14, further comprising a lighting component that is positioned adjacent the camera and configured to illuminate an object in front of the receptacle when the camera is triggered to capture an image of the object.

16. The receptacle of claim 15, further comprising a position sensor that is configured to sense a position of the top member as the top member is opened, the position of the top member being employed in triggering the camera to capture the image as the top member is being opened and being further employed in gradually increasing an intensity of light that is emitted from the lighting component as the top member is opened.

17. The receptacle of claim 10, further comprising an input device that enables a user to input a code that transitions the lock mechanism from the locked state to the unlocked state to allow user access to the interior space of the receptacle.

18. The receptacle of claim 10, further comprising a wireless communication device that is configured to wirelessly communicate with a local area network or with a wireless communication device of another receptacle.

* * * * *